US011054121B2

(12) United States Patent
Dyson et al.

(10) Patent No.: US 11,054,121 B2
(45) Date of Patent: Jul. 6, 2021

(54) LIGHTING DEVICE

(71) Applicant: Dyson Technology Limited, Wiltshire (GB)

(72) Inventors: Jacob Dyson, London (GB); William John Darvill, Bristol (GB); Toby James Shelton-Smith, Bath (GB); Davide Leoni, Bristol (GB); Mark Kristof Detre, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

(21) Appl. No.: 16/102,245

(22) Filed: Aug. 13, 2018

(65) Prior Publication Data

US 2019/0056094 A1 Feb. 21, 2019

(30) Foreign Application Priority Data

Aug. 15, 2017 (GB) ..... 1713054.3

(51) Int. Cl.

| | |
|---|---|
| ***F21V 21/14*** | (2006.01) |
| ***F21S 6/00*** | (2006.01) |
| ***F21V 23/06*** | (2006.01) |
| ***F21Y 115/10*** | (2016.01) |
| ***F21V 23/00*** | (2015.01) |

(52) U.S. Cl.

CPC ..... *F21V 21/14* (2013.01); *F21S 6/003* (2013.01); *F21V 23/06* (2013.01); *F21V 23/002* (2013.01); *F21Y 2115/10* (2016.08)

(58) Field of Classification Search

CPC ..... F21S 6/003; F21V 21/14; F21V 23/002; F21V 23/06; F21Y 2115/10

See application file for complete search history.

(56) References Cited

U.S. PATENT DOCUMENTS 3,790,773 A 2/1974 Sapper
4,463,413 A * 7/1984 Shirley ..... F21V 21/14 362/18

(Continued)

FOREIGN PATENT DOCUMENTS

CN 201739997 U 2/2011
DE 20306696 7/2003

(Continued)

OTHER PUBLICATIONS

International Search Report and Written Opinion dated Aug. 24, 2018, directed to International Application No. PCT/GB2018/051707; 9 pages.

(Continued)

*Primary Examiner* — Tsion Tumebo

(74) *Attorney, Agent, or Firm* — Morrison & Foerster LLP

(57) ABSTRACT

A lighting device includes a support and an arm which is mountable on the support in a selected orientation for movement relative thereto. The arm has a channel extending at least partially along the length of the arm. A light source is mounted on the arm. A first electrical connector is mounted on the support, and a second electrical connector is mounted on the arm. The second electrical connector is detachably electrically connected to the first electrical connector, and is moveable along the channel with lengthwise movement of the arm relative to the support.

14 Claims, 28 Drawing Sheets

(56) References Cited

U.S. PATENT DOCUMENTS

| | | | | |
|---|---|---|---|---|
| 5,023,755 | A * | 6/1991 | Rosenberg | F16M 11/10 248/124.1 |
| 5,448,464 | A * | 9/1995 | Moss | F21L 14/04 362/220 |
| 6,517,225 | B1 * | 2/2003 | Allen | B60P 3/18 362/485 |
| 8,240,894 | B2 * | 8/2012 | Sanroma | A47F 3/001 362/398 |
| 8,439,534 | B1 * | 5/2013 | Roe | F21V 11/183 362/285 |
| 9,955,553 | B2 * | 4/2018 | Fletcher | H05B 37/0227 |
| 2004/0100794 | A1 * | 5/2004 | Michael | F21S 9/032 362/183 |
| 2008/0278932 | A1 * | 11/2008 | Tress | A47B 97/00 362/133 |
| 2011/0292665 | A1 | 12/2011 | Payne | |
| 2014/0029248 | A1 | 1/2014 | Dyson et al. | |
| 2014/0226315 | A1 * | 8/2014 | Nicieja | H01R 13/6205 362/127 |
| 2016/0146445 | A1 * | 5/2016 | Shine | F21V 23/06 362/234 |
| 2016/0190735 | A1 * | 6/2016 | Zantout | H01R 13/6205 362/249.02 |
| 2016/0265755 | A1 * | 9/2016 | Lu | F21V 21/14 |
| 2018/0224103 | A1 * | 8/2018 | Crandell | F21V 21/005 |

FOREIGN PATENT DOCUMENTS

| | | |
|---|---|---|
| DE | 202007004787 | 7/2007 |
| DE | 102009037021 | 4/2011 |
| JP | 57-182818 | 11/1982 |
| JP | 3-25801 | 2/1991 |
| JP | 2016-31858 | 3/2016 |
| WO | 2016/041850 | 3/2016 |

OTHER PUBLICATIONS

Search Report dated Feb. 7, 2018, directed to GB Application No. 17130543; 1 page.

The First Office Action dated Sep. 2, 2020, directed to CN Application No. 201810920867.7; 14 pages.

* cited by examiner

LIGHTING DEVICE

REFERENCE TO RELATED APPLICATIONS

This application claims the priority of United Kingdom Application No. 1713054.3, filed Aug. 15, 2017, the entire contents of which are incorporated herein by reference.

FIELD OF THE INVENTION

The present invention relates to a lighting device. In a preferred embodiment, the lighting device is in the form of a lamp, which may be in the form of a desk or table lamp, or a floor-standing lamp. Alternatively, the device may be in the form of a wall or ceiling-mounted lighting device.

BACKGROUND OF THE INVENTION

With reference to FIGS. 1(*a*) to 1(*c*), U.S. 2014-0029248 describes a lighting device 10 which comprises a vertical support 12 and an elongate horizontal arm 14 which is mounted on the support 12 for movement relative thereto in both a vertical direction and a horizontal direction. The arm 14 includes a light source 16 mounted on one end of the arm 14, a heat sink 18 extending along the arm 14, and a heat pipe for conveying heat generated by the light source 16 during use of the lighting device 10 to the heat sink 18. The heat sink 18 defines channels 20 which extend along the top and bottom surfaces of the arm 14. The arm 14 is connected to the support 12 by a sheet support 22. The sheet support 22 comprises a first set of wheels 24 which are configured to ride along the channels 20 of the arm 14 to allow the arm 14 to slide horizontally relative to the vertical support 12. The sheet support 22 also comprises a second set of wheels 26 which are configured to ride along channels 28 formed in the vertical side surfaces of the support 12. This allows the sheet support 22, and thus the arm 14, to slide along the support 12 and so adjust the vertical position of the light source 20.

The light source 16 is connected to a power cable 30 by a plurality of flat flexible cables. The light source 16 is connected to a first end of a first flat flexible cable which runs along the arm 14. A second end of the first flat flexible cable is connected to a first electrical contact positioned on a first side of the sheet structure 22. The first electrical contact is connected to a second electrical contact on an opposite side of the sheet structure 22. The second electrical contact is connected to a first end of a second flat flexible cable which runs along the vertical support 12. A second end of the second flat flexible cable is electrically connectable to the power cable 30.

The vertical support 12 is mounted on a base 32 such that the vertical support 12 can rotate relative to the base 32 about a vertical axis. Whilst this allows the angular position of the light source 16 to be adjusted or, for example, reversed by rotating the vertical support 12 by 180° relative to the base 32, a less visually appealing rear surface of the sheet support 22, as visible in FIG. 1(*c*), become more apparent to the user.

SUMMARY OF THE INVENTION

According to some embodiments, the present invention provides a lighting device comprising a support, a first electrical connector mounted on the support, an arm comprising a first end, a second end spaced from the first end along the length of the arm, and a channel extending at least partially along the length of the arm, a light source mounted on the arm, the arm being mountable on the support in a selected one of a first orientation, in which the light source is located to one side of the first electrical connector, and a second orientation in which the light source is located to the other side of the first electrical connector, and a second electrical connector which is connected to the light source and detachably electrically connected to the first electrical connector, the second electrical connector being moveable along the channel with lengthwise movement of the arm relative to the support.

The support is preferably a vertical support, which extends in a vertical direction during normal use of the lighting device. The arm is preferably an elongate arm which extends in a horizontal direction during normal use of the lighting device. The term "elongate arm" is used to mean an arm which has a length that is significantly larger than its maximum thickness. The terms "horizontal", "vertical", "raised", "lowered", "upper" and "lower" are used in the context of the present application to refer to relative orientations or positions of components of the lighting device when in normal use.

According to some embodiments, the present invention provides an improvement to the lighting device described in U.S. 2014-0029248 by providing an arm which is reversibly mountable on the support, that is, such that the light source may be located on a selected one of a left hand side and a right hand side of the support. This allows the user to reverse the orientation of the light source—through a 180° rotation of the arm, when separated from the support, about a vertical axis—without rotating the support, and thus allowing the rear surface of the support, and of any components mounted on the support, to remain out of the line of sight of a user located in front of the lighting device. The arm and the support may also be supplied to a user as separate components within a box or other package for subsequent assembly by the user prior to use of the lighting device. This enables the size of the package to be reduced, thereby affording reduced transportation costs.

The lighting device includes a first electrical connector mounted on the support. The first electrical connector is preferably connectable to a power source, for example by a power cable of the lighting device. The lighting device further comprises a second electrical connector which is connected to the light source. The electrical connectors preferably establish an electrical connection therebetween through physical contact. The light source is preferably located at or towards one of the ends of the arm.

To maintain the electrical connection between the electrical connectors, and thus between the light source and a power source, as the arm is moved lengthwise relative to the support, the second electrical connector is moveable relative to the arm. The second electrical connector is mounted on the arm so as to be moveable along the channel extending at least partially along the length of the arm. The channel is preferably located on one of an upper surface and a lower surface of the arm, more preferably on the lower surface of the arm. The second electrical connector may be connected to the light source by a ribbon cable which allows the second electrical connector to move along the channel and relative to the light source whilst maintaining the integrity of the electrical connection between the light source and the second electrical connector.

To allow the arm to be disconnected from the support, reversed in orientation and subsequently reconnected to the support, the first electrical connector is disconnectable from, and reconnectable to, the second electrical connector. The disconnection between the electrical connectors is preferably performed manually by the user, that is, without the use of any tools.

In a preferred embodiment, the first electrical connector is moveable relative to the support to connect it to the second electrical connector. The first electrical connector may be translatable, rotatable or slidable relative to the support, but in a preferred embodiment the first electrical connector is pivotable relative to the support.

To facilitate the establishment of the electrical connection between the electrical connectors, the second electrical connector is preferably magnetically attracted towards the first electrical connector. For example, each electrical connector may comprise a respective magnet, with the poles of the magnets being orientated so that the magnets are magnetically attracted towards each other.

The first electrical connector preferably comprises at least one electrical contact of a first printed circuit board (PCB). The first PCB is preferably mounted on a ledge which is connected to the support for movement relative thereto. A first magnet is mounted on the ledge. The ledge is preferably pivotably movable relative to the support between a first position in which an electrical connection can be established between the electrical connectors, and a second position which is spaced from the first position. The ledge is preferably biased towards its second position, and is thus preferably arranged to move from its second (disconnected) position to its first (connected) position under the influence of the magnetic force of attraction between the magnets.

The second electrical connector is preferably located on a lower side of the arm. The first position is thus preferably a raised position of the ledge and the second position is preferably a lowered position of the ledge. The ledge is preferably substantially horizontal when in its first position. The ledge is preferably biased towards its lowered position under the weight of the carrier, the first PCB, and the first magnet so that when the second electrical connector is moved away from the first electrical connector during disassembly of the arm and the support, the ledge moves automatically to its lowered position.

The second electrical connector preferably comprises at least one spring-loaded pin, for example a pogo pin, for engaging a contact of the first PCB to establish the electrical connection between the electrical connectors. Preferably, the first electrical connector comprises at least one pair of electrical contacts, and the second electrical connector comprises a pair of pins for engaging a pair of electrical contacts. In a preferred embodiment, the first electrical connector comprises a first pair of electrical contacts for engaging the pair of pins when the arm is connected to the support in the first orientation, and a second pair of electrical contacts for engaging the pair of pins when the arm is connected to the support in the second orientation.

Each pin is preferably connected to a second PCB. The second PCB is preferably mounted on a carriage which is moveable along the channel, and thus relative to the light source. A second magnet is mounted on the carriage. When the arm is subsequently reconnected to the support and the second electrical connector is located adjacent to, and preferably immediately above, the first electrical connector, the ledge moves automatically to its raised position, due to the magnetic attraction of the first magnet towards the second magnet, to re-establish the electrical connection between the contact and the pin.

The arm is preferably mounted on the support for movement relative thereto in a sliding direction which extends parallel to the direction of the length of the arm. Thus, the arm is preferably moveable relative to the support in a horizontal direction. The channel preferably extends in a direction parallel to the sliding direction of the arm.

The support preferably comprises a plurality of guides for releasably retaining the arm and for guiding movement of the arm relative to the support. Each of the guides preferably comprises a roller or wheel which is rotatably mounted on a support plate. The plurality of guides preferably comprises a first set of guides for holding the arm therebetween. The first set of guides preferably comprises at least one upper guide and at least one lower guide. In a preferred embodiment, the first set of guides comprises one upper guide and two lower guides. The lower guides are preferably arranged such that the ledge is located between, preferably midway between, two lower guides.

The upper guide is preferably moveable relative to the arm between a deployed position for engaging the arm and a retracted position for allowing the arm to be detached from the support. The moveable guide may be rotated or otherwise translated manually by the user between its deployed and retracted positions. In a preferred embodiment the moveable guide is slidable manually by the user between its deployed and retracted positions. The moveable guide is preferably moveable along a slot formed in the support plate and which is inclined at an acute angle to the direction of the length of the arm.

The moveable guide is preferably biased towards its deployed position, for example by a spring or other resilient element. To connect the arm to the support, the user moves the moveable guide to its retracted position to increase the vertical spacing between the upper and lower guides. The arm is then inserted between the upper and lower guides, preferably such that the arm is sited on the two lower guides and more preferably so that each of the lower guides is at least partially received within the channel The user then releases the moveable guide to allow it to move automatically to its deployed position to engage the arm, resulting in the arm becoming retained between the upper and lower guides. The moveable guide is preferably at least partially located in a second channel of the arm when in its deployed position. The second channel is preferably parallel to the channel within which the lower guides are at least partially received, and is preferably located on an opposite side of the arm to said channel Depending on the relative positions of the arm and the support when the arm is mounted on the support, the electrical connection between the electrical connectors may be established automatically when the arm is first mounted on the support. If not, then once the arm has been received between the guides, the arm is moved by the user in the sliding direction relative to the support to a position in which the electrical connectors form the electrical connection, through the movement of the first electrical connector towards the second electrical connector.

The plurality of guides preferably comprises a second set of guides for guiding movement of the support plate along the support, and thus movement of the arm relative to the support in a vertical direction. The second set of guides preferably comprises at least one left side guide, and at least one right side guide for holding the support therebetween. In preferred embodiment, the second set of guides comprises two left side guides and one right side guide. Each of the guides is preferably at least partially received in a channel formed in the support. The left side guides are preferably at least partially received in a first support channel and the right side guide is preferably at least partially received in a second support channel located on an opposite side of the support to the first support channel.

The right side guide is preferably moveable relative to the support plate between a deployed position for engaging the support and a retracted position spaced from the deployed position. The right side guide may be rotated or otherwise translated manually during assembly of the support between its deployed and retracted positions. In a preferred embodiment the right side guide is manually slidable between its deployed and retracted positions. The right side guide is preferably moveable along a slot formed in the support plate and which is inclined at an acute angle to the direction of the length of the support.

The right side guide is preferably biased towards its deployed position, for example by a spring or other resilient element. To connect the support plate to the support, the right side guide is first moved to its retracted position to enable the left side guides to be at least partially received within the first support channel. The right side guide is then released to allow it to move automatically to its deployed position and engage the support.

The support preferably comprises a counterweight which is connected to a pulley system located within the support. One or more flexible connectors preferably extend from the first connector to a power cable and around the pulley system so that movement of the support plate relative to the support in a first vertical direction causes the counterweight to move in a second vertical direction opposite to the first vertical direction.

BRIEF DESCRIPTION OF THE DRAWINGS

Preferred features of the present invention will now be described by way of example only with reference to the accompanying drawings, in which.

DETAILED DESCRIPTION OF THE INVENTION

An embodiment of a lighting device 40 of the present invention will be described with reference to FIGS. 2(*a*) to 13(*b*). In this embodiment, the lighting device is in the form of a desk lamp, but alternative embodiments include a floor-standing lamp and a wall-mounted light. The lighting device 40 comprises a vertical support 42 and an elongate arm 44 which is reversibly mountable on the support 42 by a user, that is, in a selected one of a first orientation and a second orientation which is angularly spaced from the first orientation by a 180° rotation about a vertical axis.

Figure 1A:
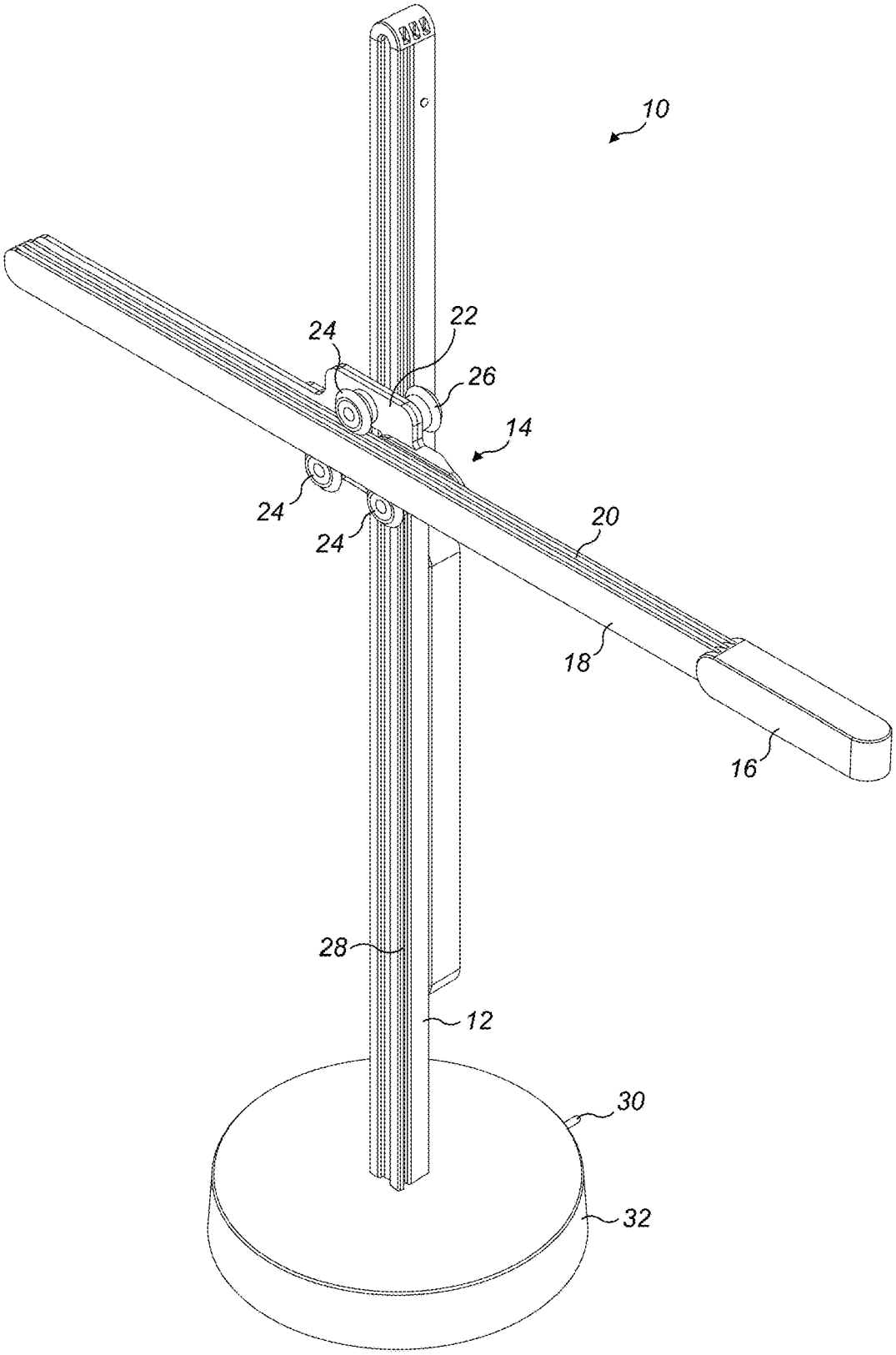
FIG. 1(a) Prior Art
FIG. 1(*a*) is a perspective view, from above, of a prior lighting device, FIG. 1(*b*) is a front view of the prior lighting device, and FIG. 1(*c*) is a rear view of the prior lighting device.
Figure 1B:
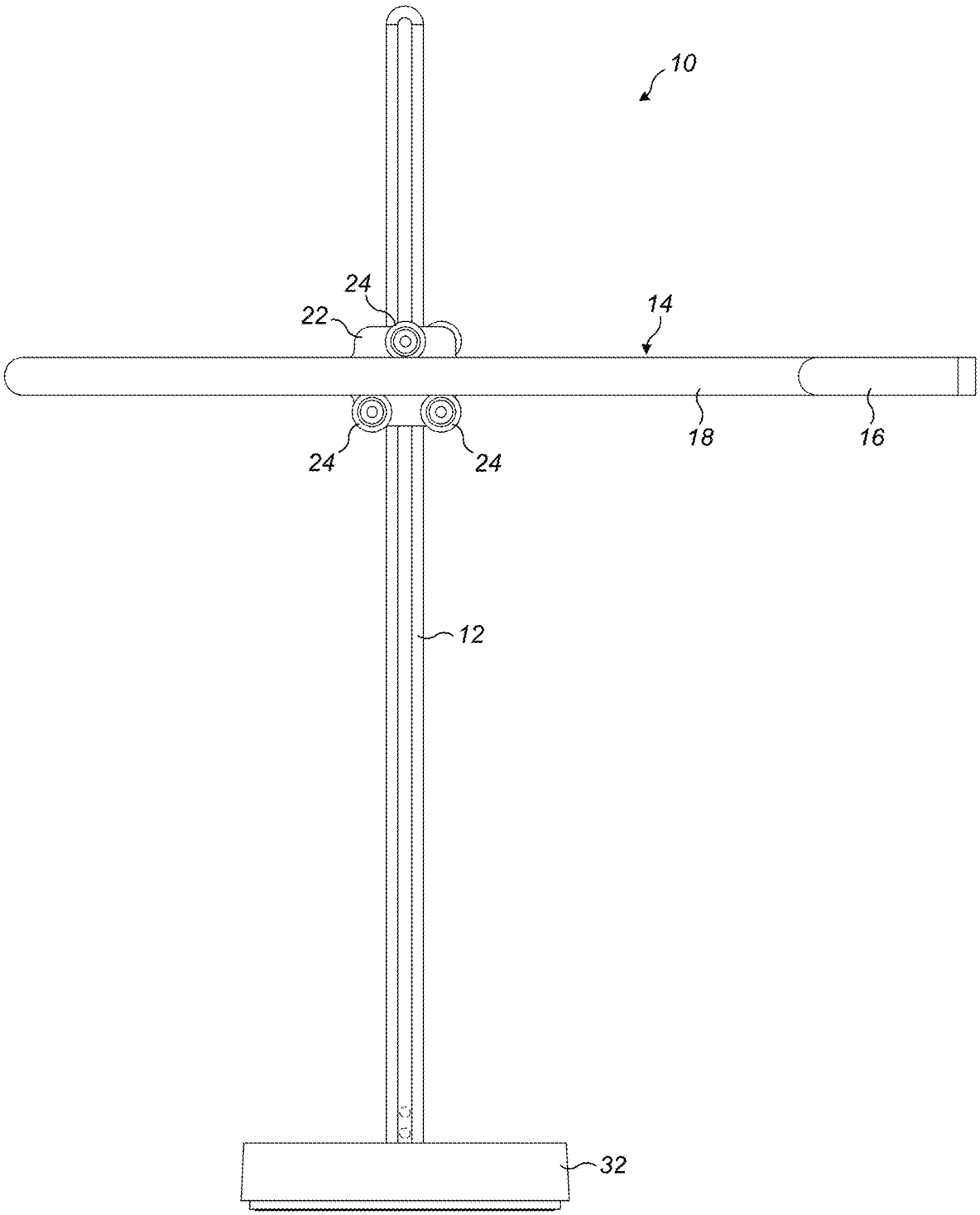
FIG. 1(b) Prior Art
Figure 1C:
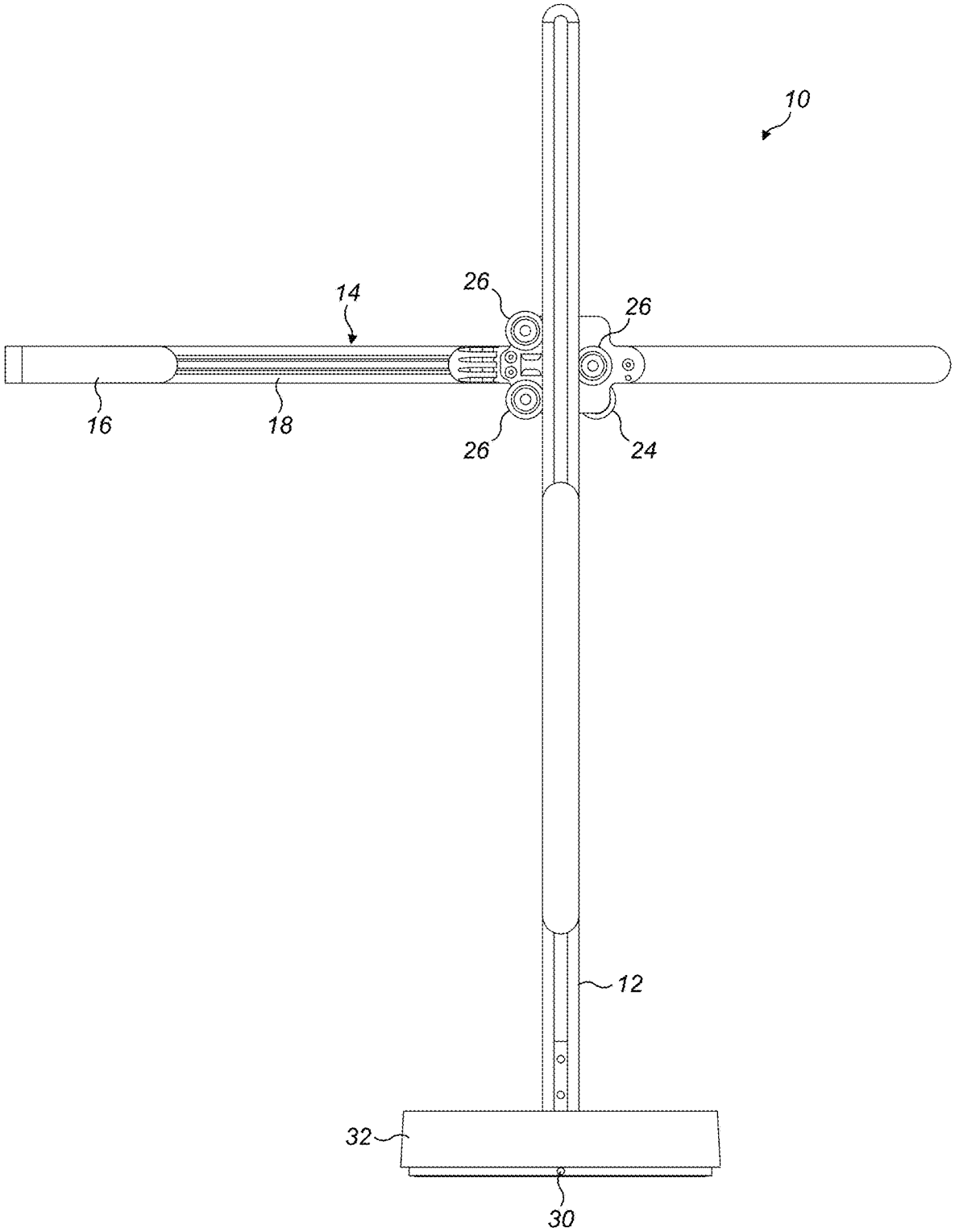
FIG. 1(c) Prior Art
Figure 2A:
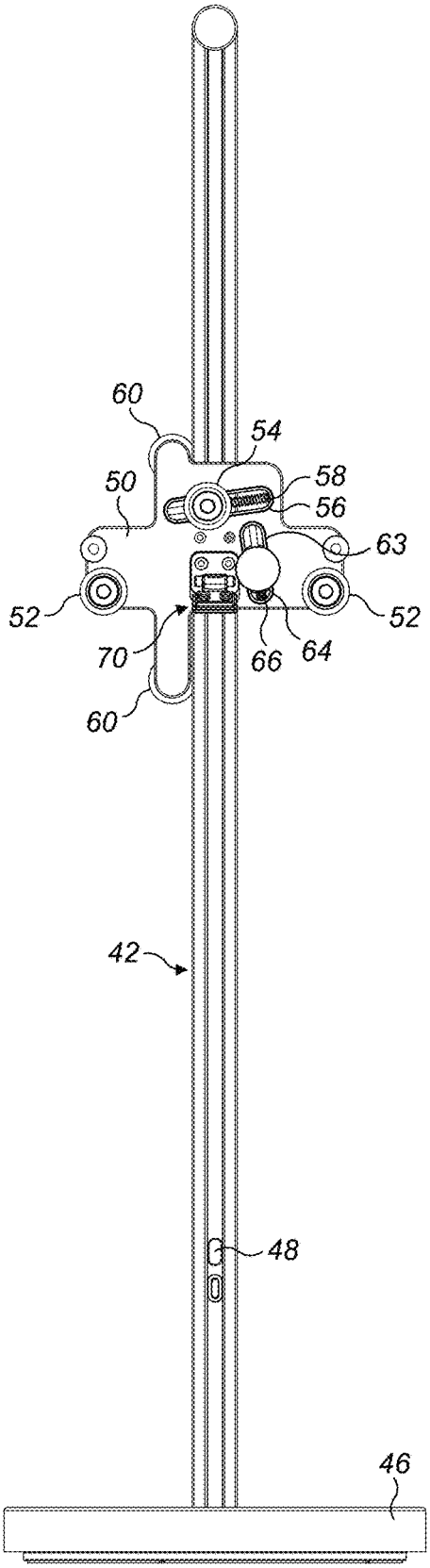
FIG. 2(*a*) is a front view of a support of a lighting device of the present invention, FIG. 2(*b*) is a perspective view, from above, of the support, FIG. 2(*c*) is a front view of a support plate of the support, FIG. 2(*d*) is a sectional view taken along line A-A in FIG. 2(*c*), and FIG. 2(*e*) is a perspective view of the support plate.
Figure 2B:
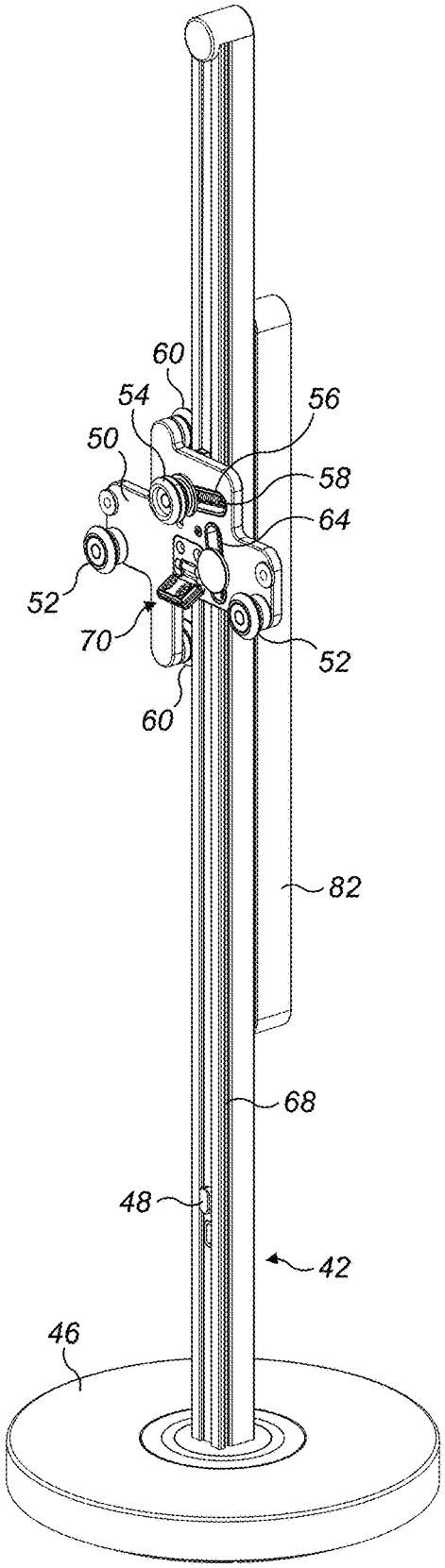
Figure 2C:
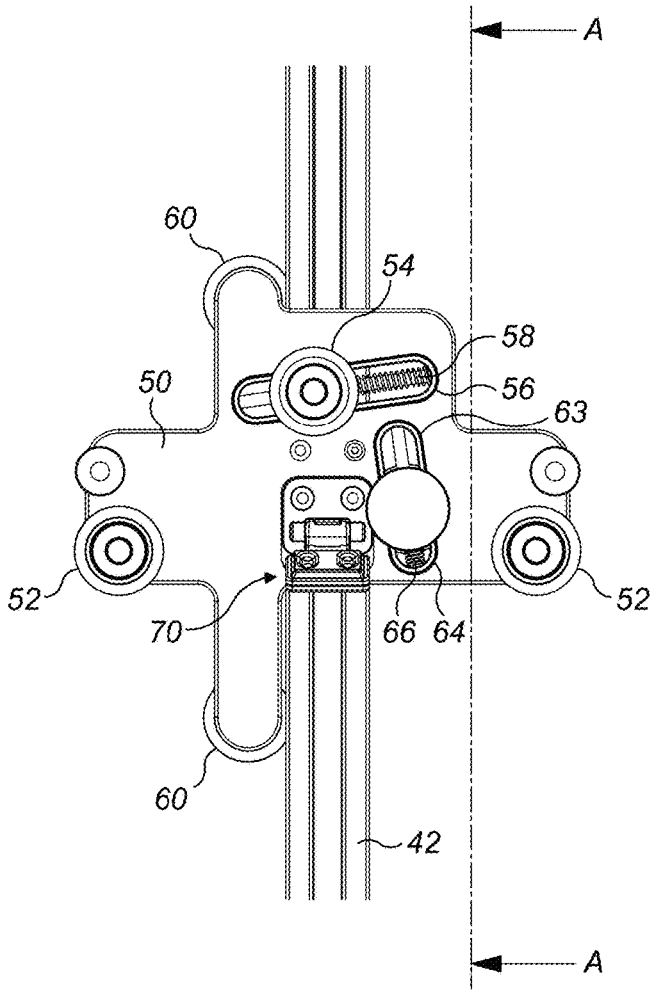
Figure 2D:
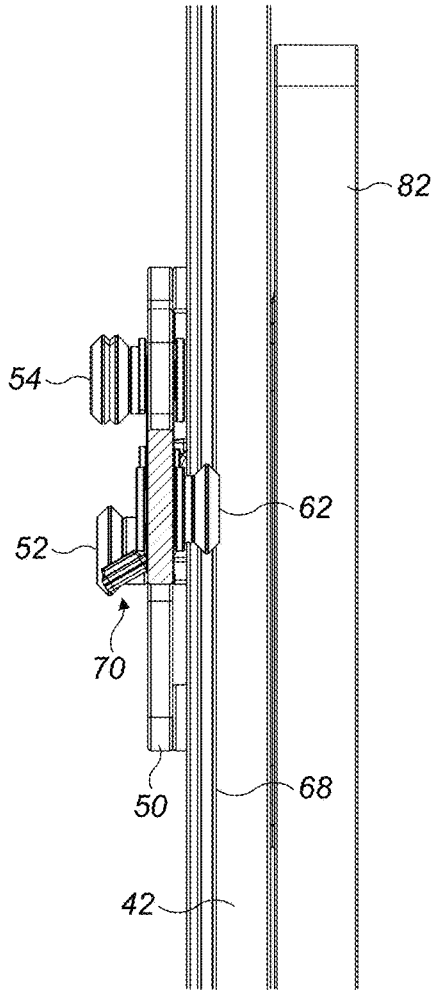
Figure 2E:
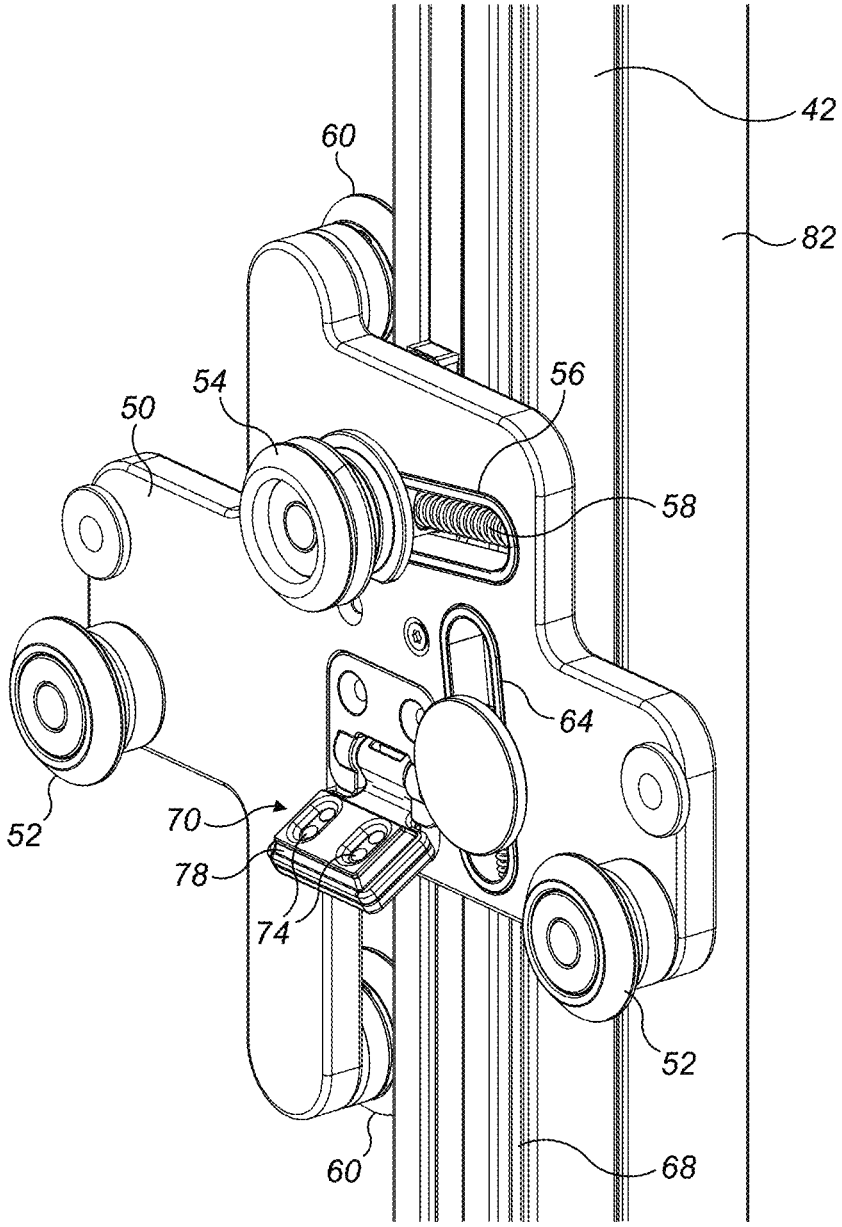
Figure 3A:
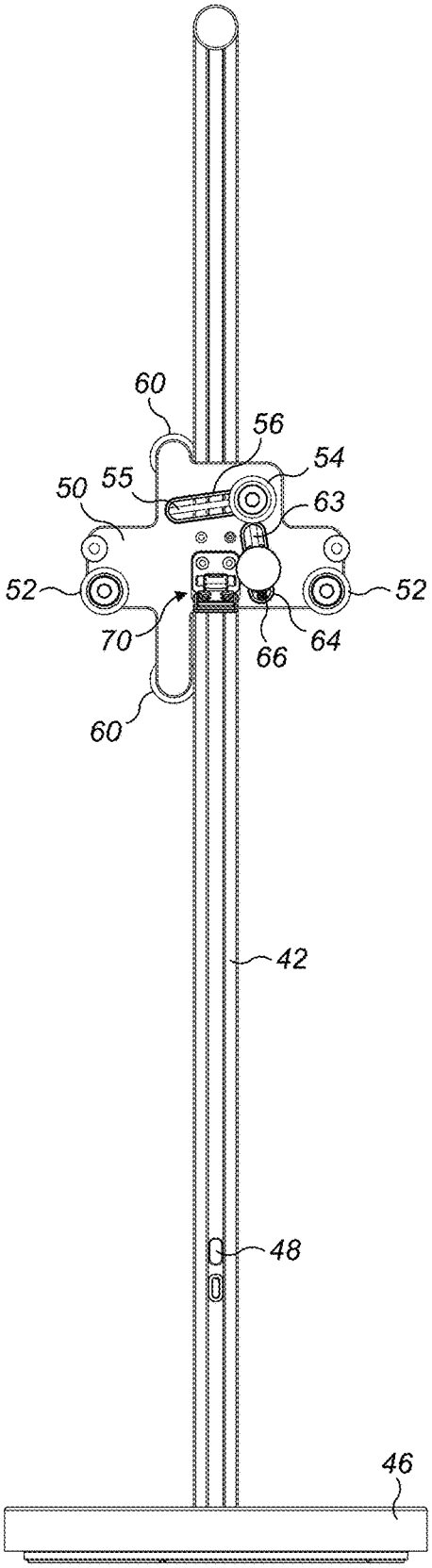
FIG. 3(*a*) is a front view of the support with an upper guide of the support plate in a retracted position, and FIG. 3(*b*) is a perspective view of the support plate with the upper guide in the retracted position.
Figure 3B:
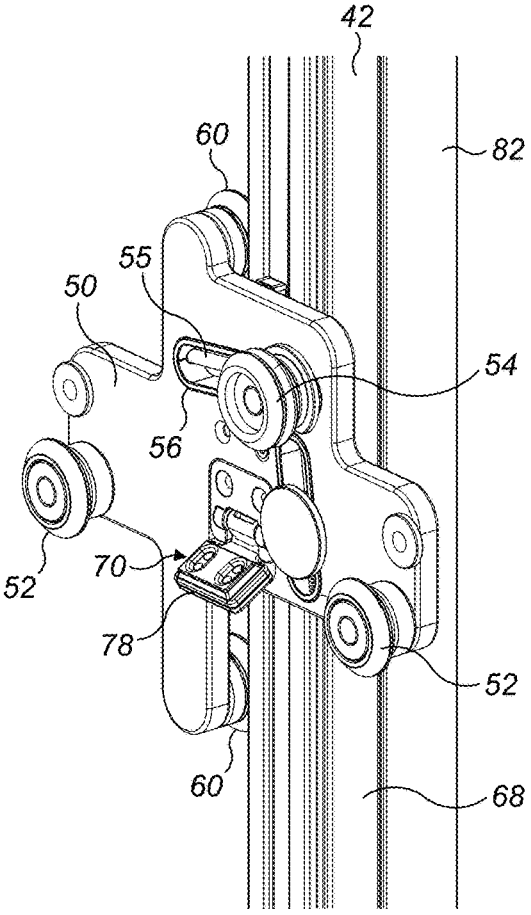
Figure 4A:
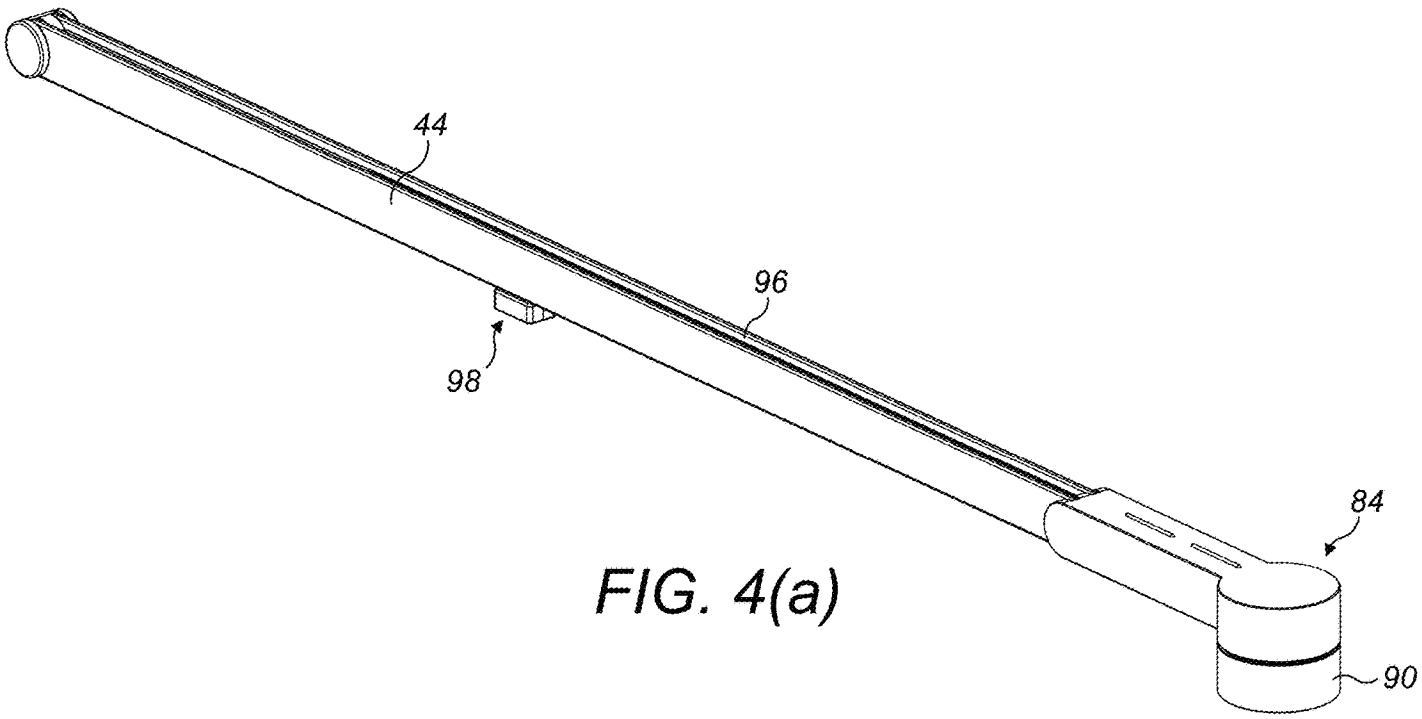
FIG. 4(*a*) is a perspective view, from above, of an arm of the lighting device of the present invention, FIG. 4(*b*) is a close up of part of FIG. 4(*a*), FIG. 4(*c*) is a perspective view, from below, of the arm, and FIG. 4(*d*) is a close up of part of FIG. 4(*c*)
Figure 4B:
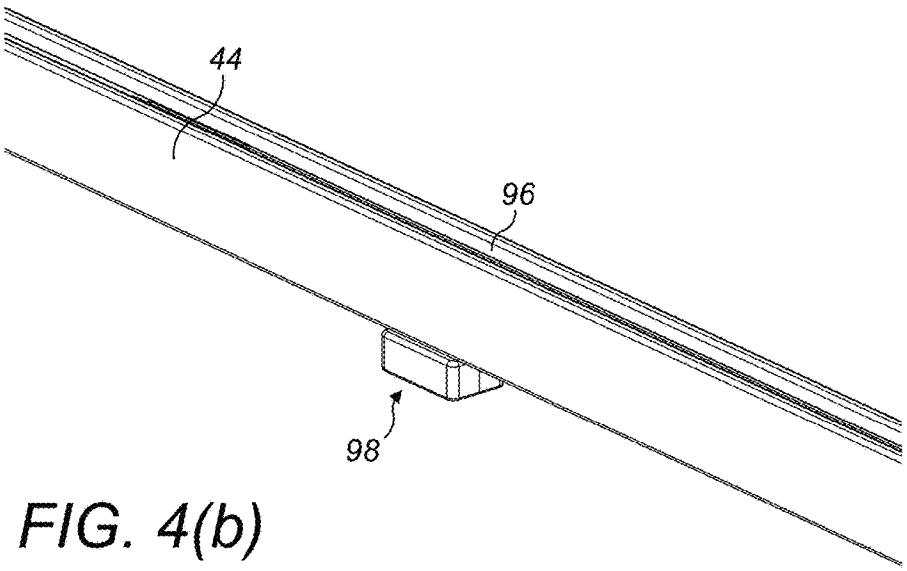
Figure 4C:
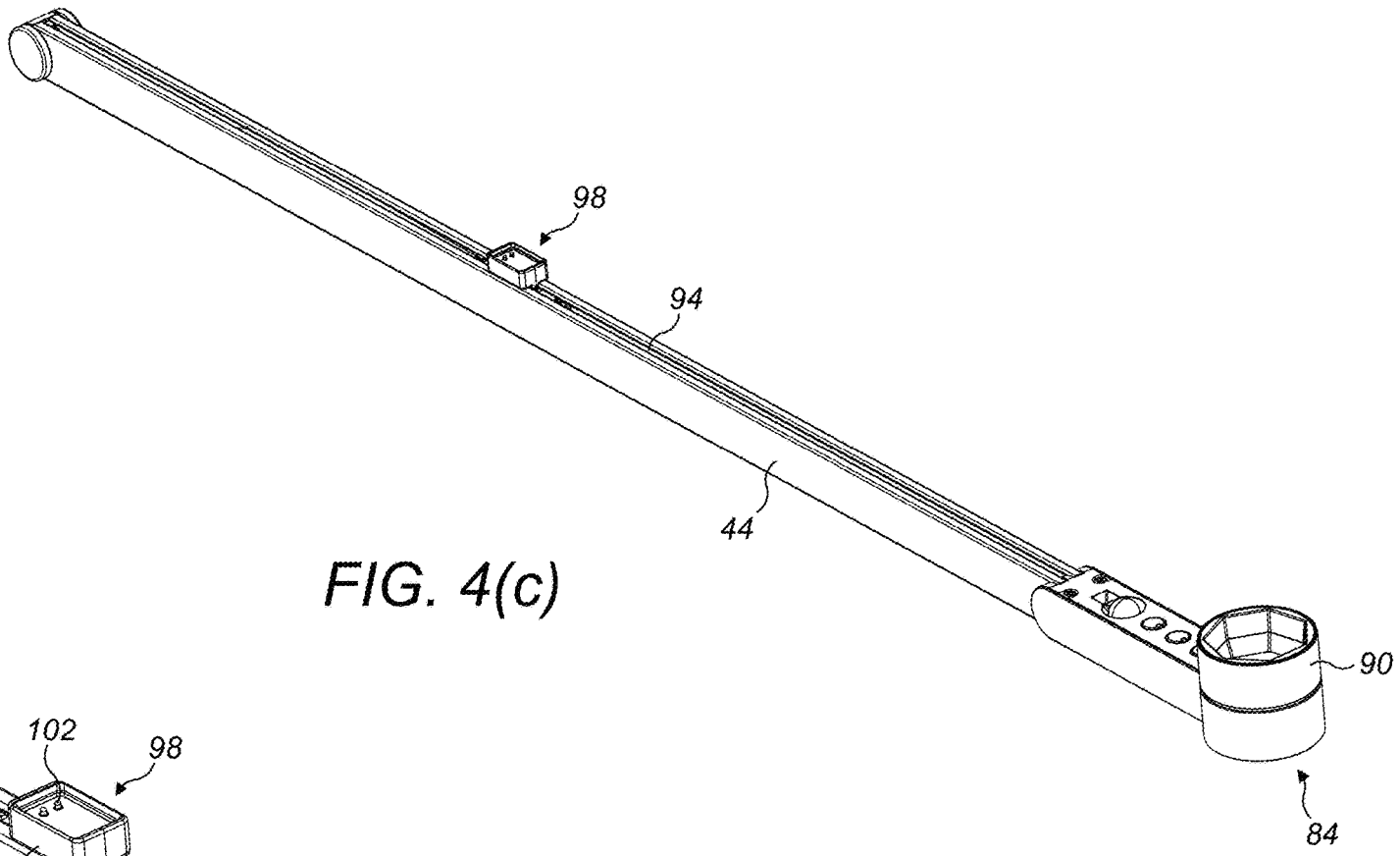
Figure 4D:
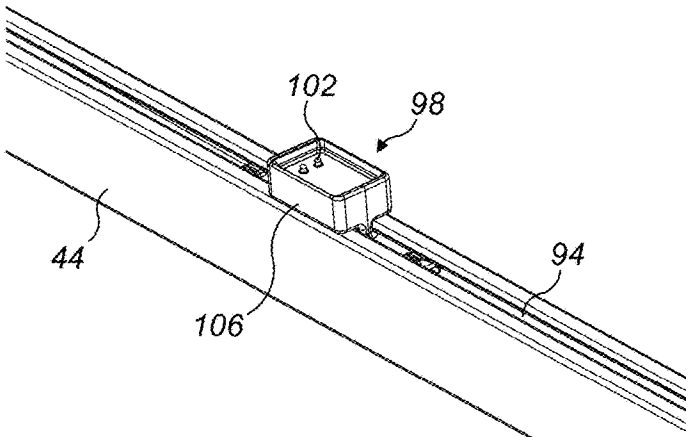

The support 42 is illustrated in FIGS. 2(*a*) to 2(*e*). The support 42 is mounted on a base 46 such that the support 42 is rotatable relative to the base 46 about a vertical axis. A switch 48 for turning the lighting device 40 on and off is mounted on a front surface of the support 42. A support plate 50 for supporting the arm 44 is connected to the support 42. The support plate 50 comprises a plurality of guides for guiding movement of moveable components of the lighting device 40 relative to the support 42. In this embodiment, each of the guides comprises a roller or wheel rotatably mounted on the support plate 50. The support plate 50 comprises a first set of guides mounted on a front surface of the support plate 50 for supporting the arm 44 for movement relative thereto in a sliding direction parallel to the direction of the length of the arm 44. The first set of guides comprises two lower guides 52 and an upper guide 54. The lower guides 52 are mounted in a fixed position on the support plate 50 and such that their rotational axes are located in a horizontal plane. The upper guide 54 is moveable relative to the support plate 50 along a rod 55 located within a first slot 56 formed in the support plate 50. The first slot 56 is inclined at an acute angle to the horizontal. The upper guide 54 is moveable manually by the user between a deployed position, as illustrated in FIGS. 2(*a*) to 2(*e*), and a retracted position, as illustrated in FIGS. 3(*a*) and 3(*b*). The upper guide 54 is biased towards its deployed position by a spring 58 or other resilient element.

The support plate 50 further comprises a second set of guides mounted on a rear surface of the support plate 50 for guiding movement of the support plate 50 relative to the support 42 in a vertical direction. The second set of guides comprises two left side guides 60 and a right side guide 62. The left side guides 60 are mounted in a fixed position on the support plate 50 and such that their rotational axes are located in a vertical plane. The left side guides 60 are partially received within a first support channel (not shown) formed in the left side vertical surface of the support 42 and which extends in a vertical direction. The right side guide 62 is moveable relative to the support plate 50 along a rod 63 located within a second slot 64 formed in the support plate 50. The second slot 64 is inclined at an acute angle to the vertical. The right side guide 62 is moveable between a deployed position, as illustrated in FIGS. 2(*a*) to 2(*e*), and a retracted position, and is biased towards its deployed position by a spring 66 or other resilient element. During assembly of the support 42, the right side guide is moved to its retracted position, and the support plate 50 is positioned on the support 42 such that the left side guides 60 are partially received within the first support channel. The right side guide is then released so that it moves, under the force of the spring 66, to its deployed position to partially enter a second support channel 68 formed in the right side vertical surface of the support 42. The second support channel 68 extends parallel to the first support channel.

Figure 8A:
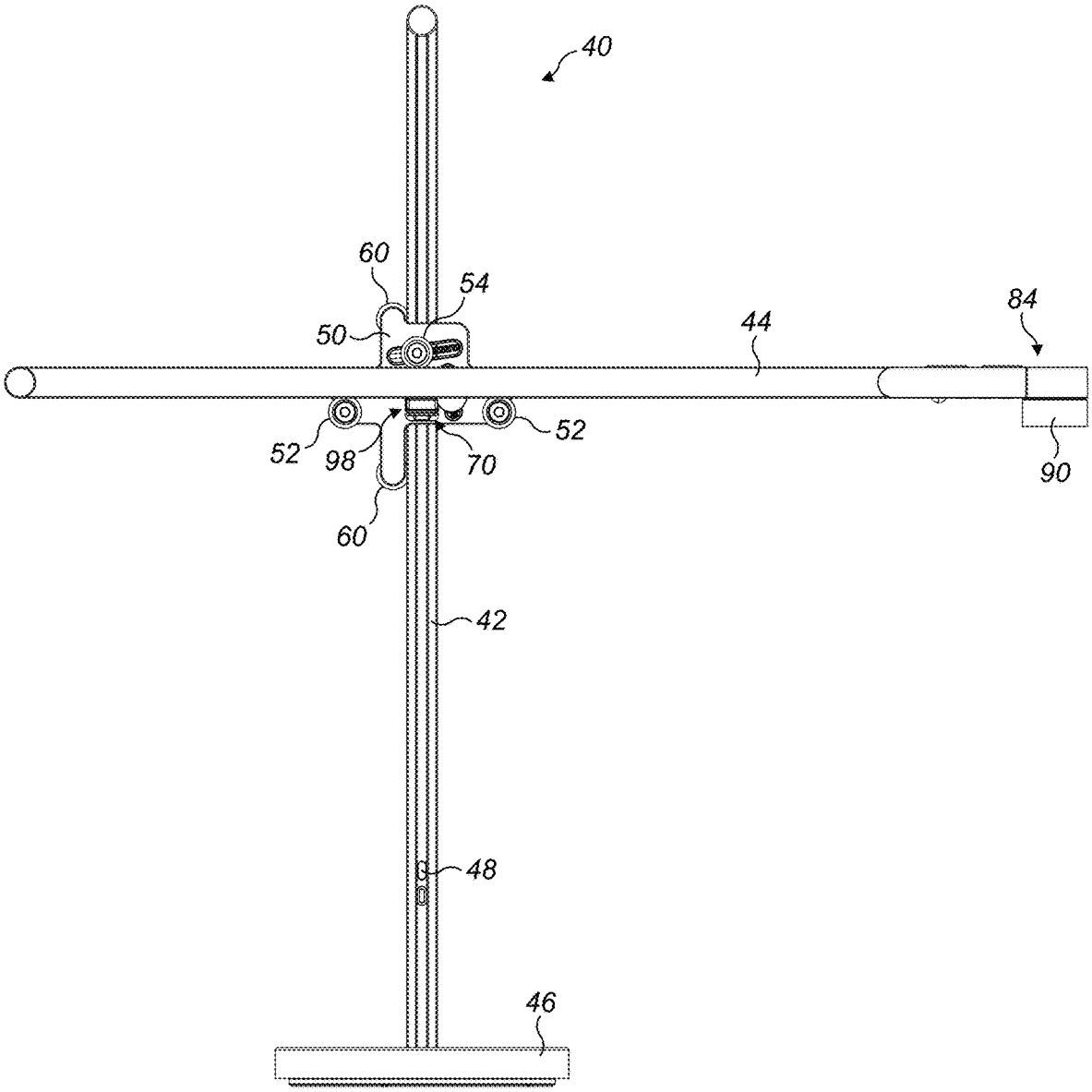
FIG. 8(*a*) is a front view of the lighting device as illustrated in FIG. 7(*a*) but with the first electrical connector in a raised position, and FIG. 8(*b*) is a perspective view of part of the lighting device as illustrated in FIG. 8(*a*)
Figure 8B:
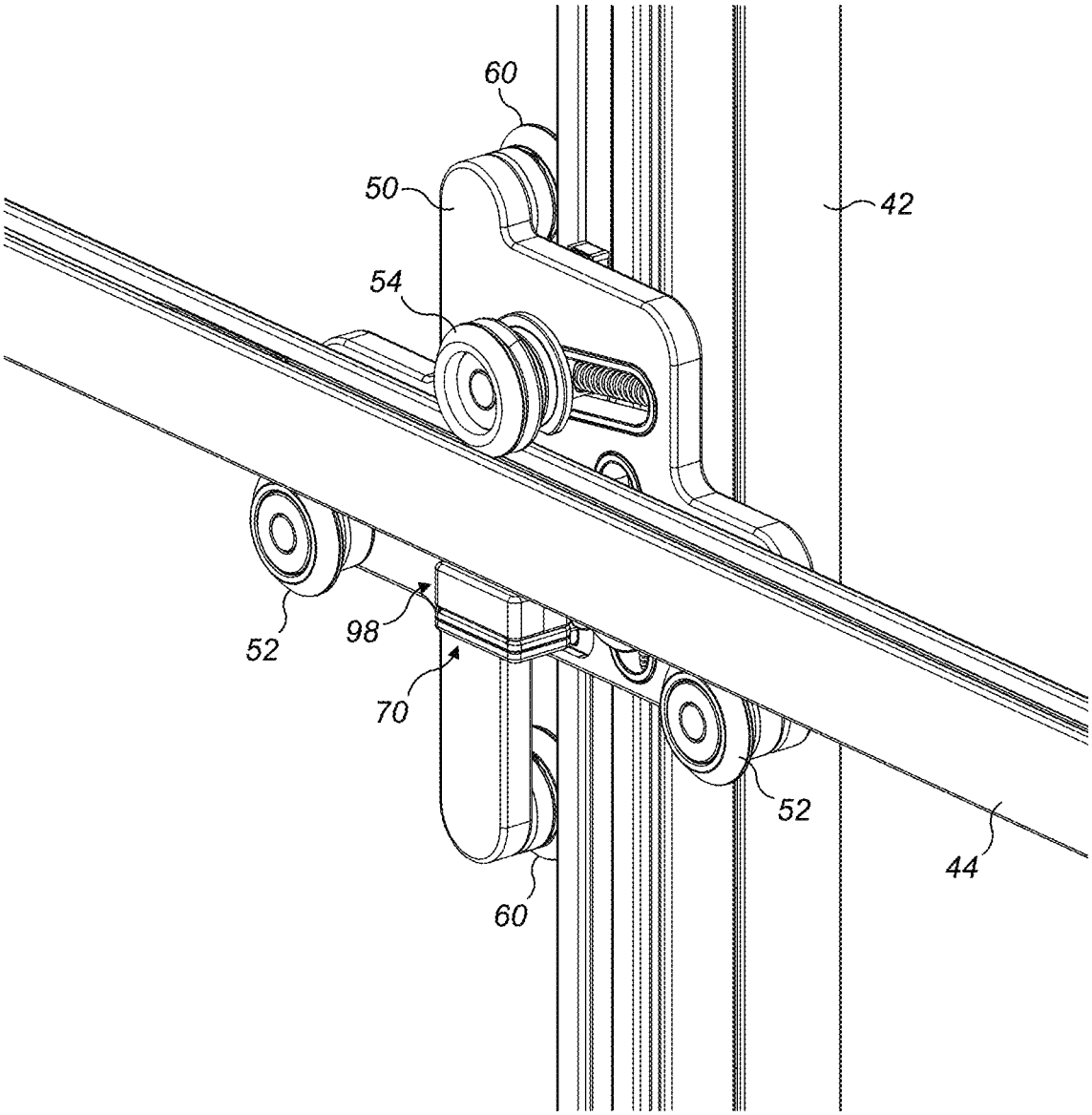
Figure 9A:
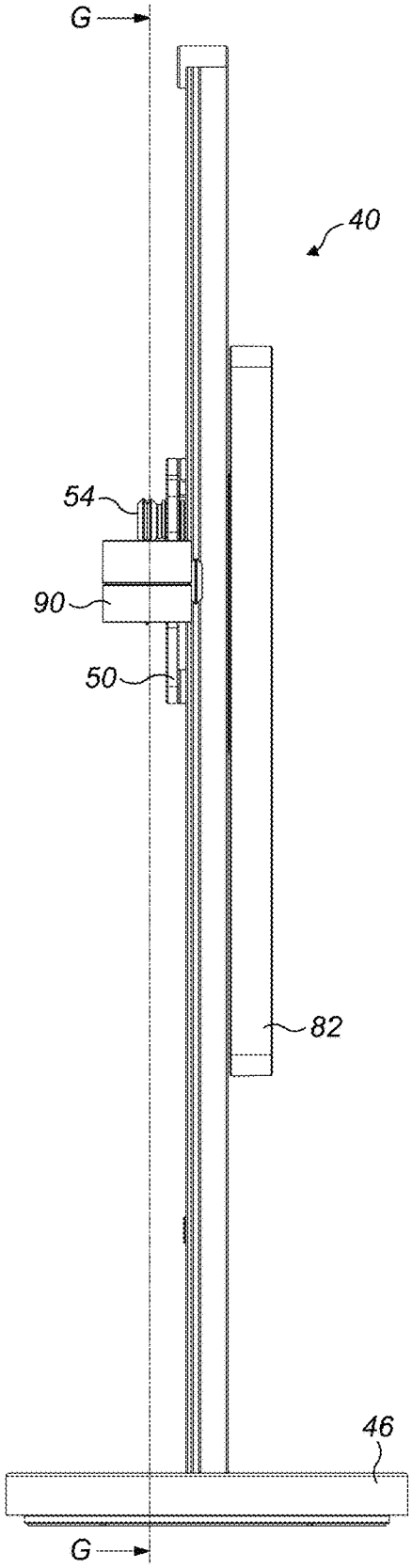
FIG. 9(*a*) is a side view of the lighting device as illustrated in FIG. 8(*a*), FIG. 9(*b*) is a sectional view taken along line G-G in FIG. 9(*a*), and FIG. 9(*c*) is a close up of area Z identified in FIG. 9(*b*)
Figure 9B:
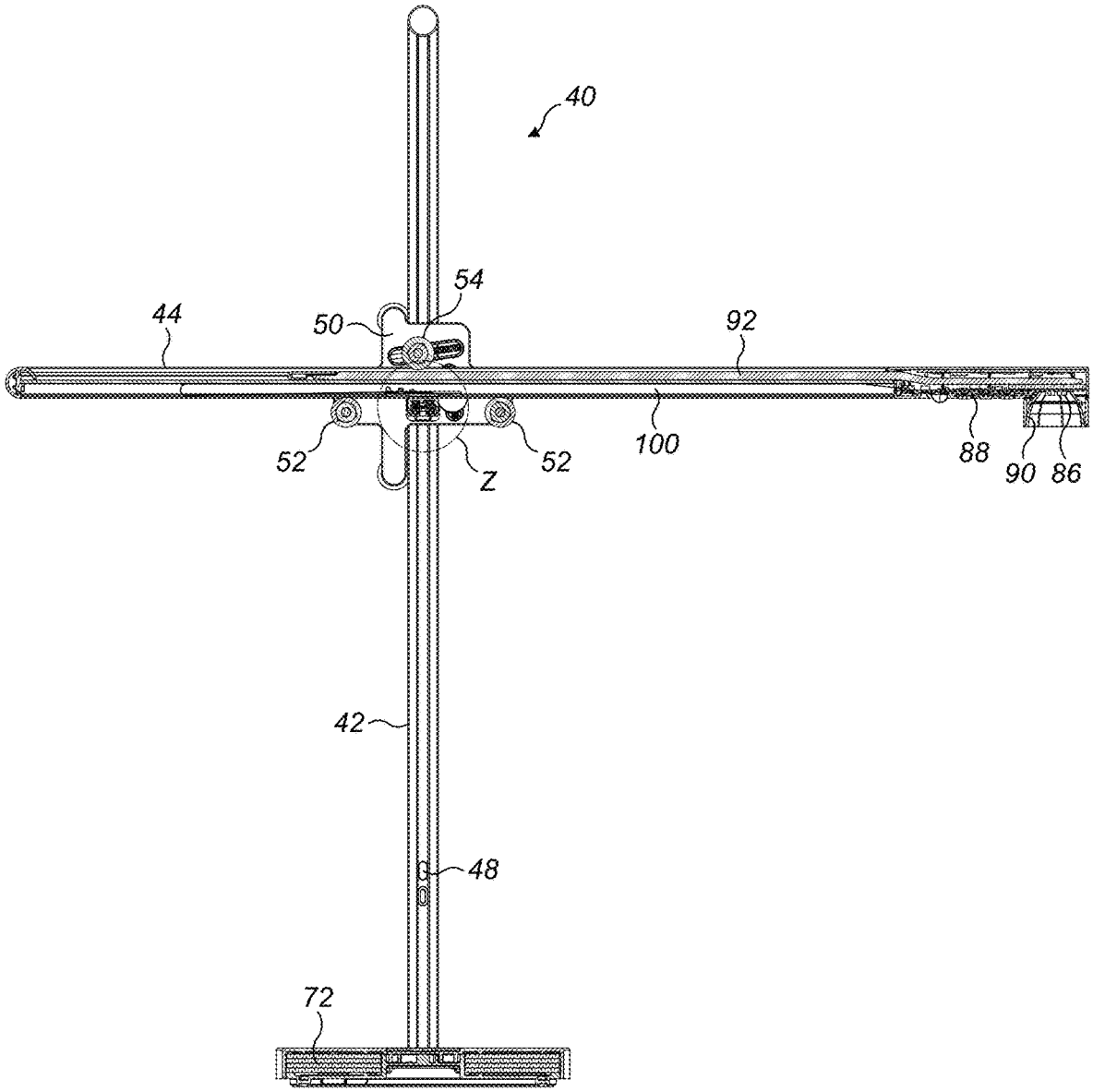
Figure 9C:
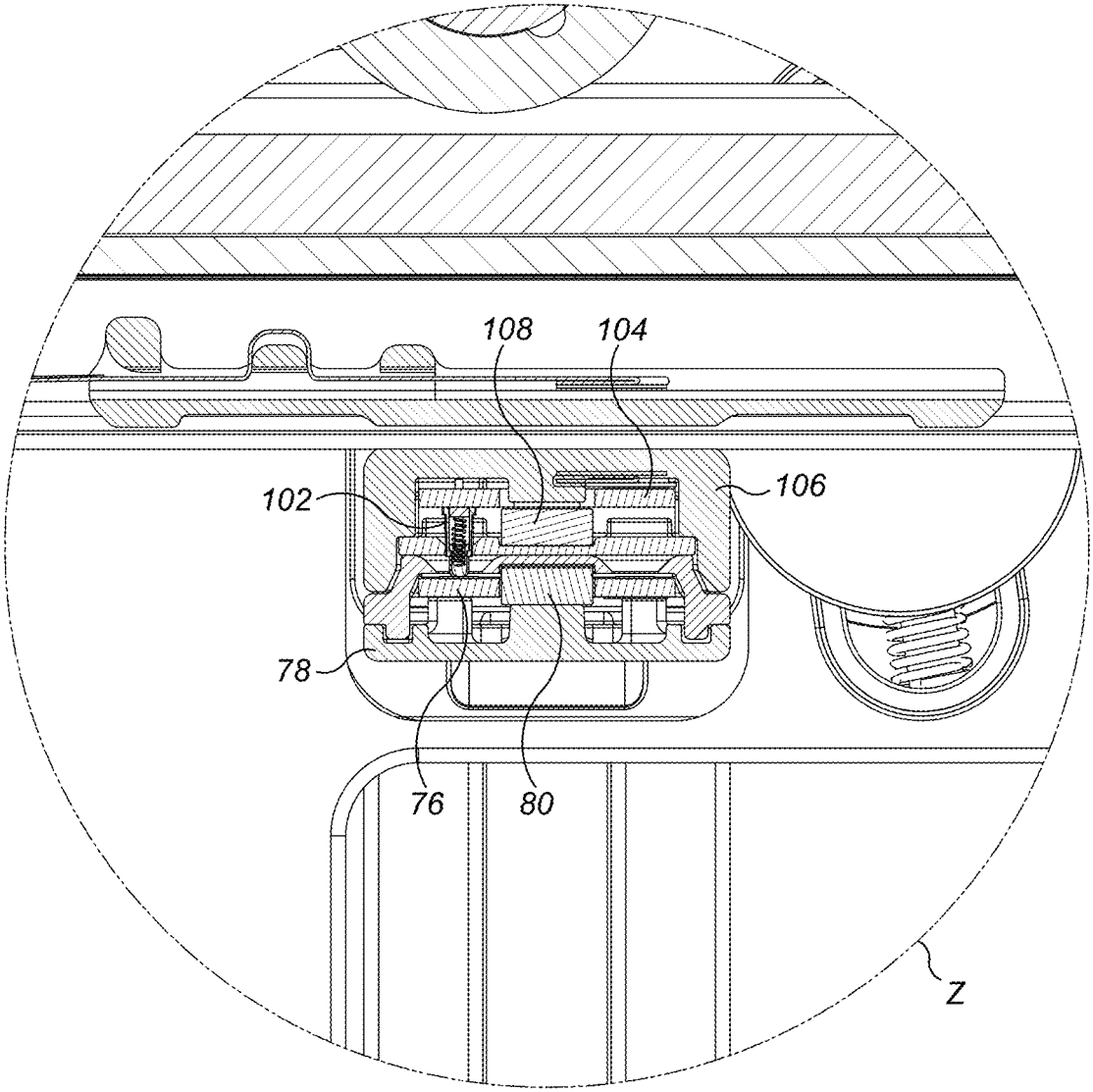

The support plate 50 also comprises a first electrical connector 70 of the lighting device 40. The first electrical connector 70 is located between, preferably midway between, the two lower guides 52. The first electrical connector 70 is connected to a power cable 72 (illustrated in FIG. 9(*b*)) which may be unwound from a reel located in the base 46 for connection to a socket. With reference also to FIGS. 9(*a*) to 9(*c*), in this embodiment the first electrical connector 70 comprises two pairs of electrical contacts 74 of a first printed circuit board (PCB) 76. The first PCB 76 is mounted on a ledge 78 which is connected to the support plate 50 for movement relative thereto between a first, raised position, as illustrated in FIGS. 8(*a*) to 9(*c*), and a second, lowered position, as illustrated in FIGS. 2(*a*) to 7(*b*). In this embodiment, the ledge 78 is mounted to the support plate 50 for pivoting movement relative thereto about a horizontal pivot axis. The ledge 78 is biased towards its lowered position under the weight of the components mounted on the ledge 78, which include a first magnet 80.

The support plate 50 is connected to a counterweight 82 which is moveable along a third support channel (not shown) located on the rear surface of the support. The connection of the support plate 50 to the counterweight 82 is described in U.S. 2014-0029248, the contents of which are incorporated herein by reference.

The arm 44 is illustrated in FIGS. 4(*a*) to 4(*d*). The arm 44 is elongated such that its length is significantly larger than its maximum thickness. A light source 84 is mounted on a first end of the arm 10. With reference also to FIGS. 9(*a*) to 9(*c*), the light source comprises a plurality of light emitting diodes (LEDs) 86 mounted on a PCB 88. The LEDs 86 are surrounded by an annular reflector housing 90 for directing light emitted from the LEDs 86 towards a work surface. The PCB 88 is mounted on a heat pipe 92 located within the arm 44 so that heat emitted from the LEDs 86 during use of the lighting device 40 is transferred to the heat pipe 92. The arm 44 is preferably formed from aluminium or other conductive material to enable the arm 44 to act as a heat sink to transfer heat from the heat pipe 92 to the ambient atmosphere.

The arm 44 includes a first channel 94 for receiving the lower guides 52. The first channel 94 is formed in a lower elongate surface of the arm 44, and extends in a horizontal direction. The arm also includes a second channel 96 for receiving the upper guide 54. The second channel 96 is formed in an upper elongate surface of the arm 44, and also extends in a horizontal direction.

The arm 44 includes a second electrical connector 98 which is connected to the light source 84 by a ribbon cable 100. The second electrical connector 98 is detachably electrically connectable to the first electrical connector 70 to connect the light source 84 to the power cable 72. The second electrical connector 98 comprises a pair of spring-loaded pins 102, preferably pogo pins, for engaging a first one of the pairs of electrical contacts 74 of the first electrical connector 70 to establish the electrical connection between the electrical connectors 70, 98. The pins 102 are connected to a second PCB 104, which is mounted on a carriage 106 which is moveable along the first channel 104 of the arm 44, and thus relative to the light source 84. A second magnet 108 is mounted on the carriage 106. The second magnet 108 has a reverse polarity to the first magnet 80 mounted on the ledge 78.

Figure 5A:
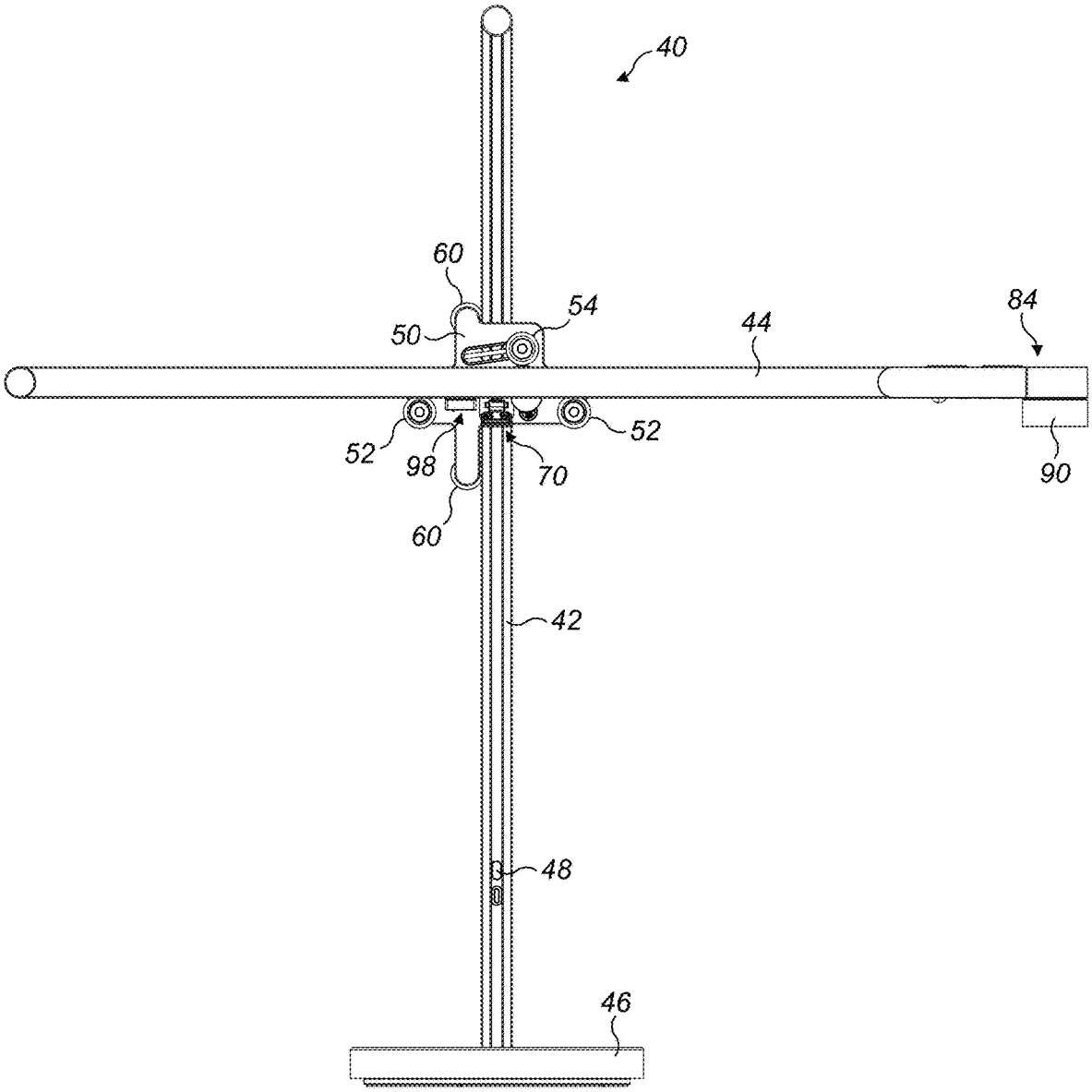
FIG. 5(*a*) is a front view of the lighting device, with the arm mounted on the support in a first orientation, a first electrical connector of the support in a lowered position and the upper guide in the retracted position, and FIG. 5(*b*) is perspective view of part of the lighting device as shown in FIG. 5(*a*)
Figure 5B:
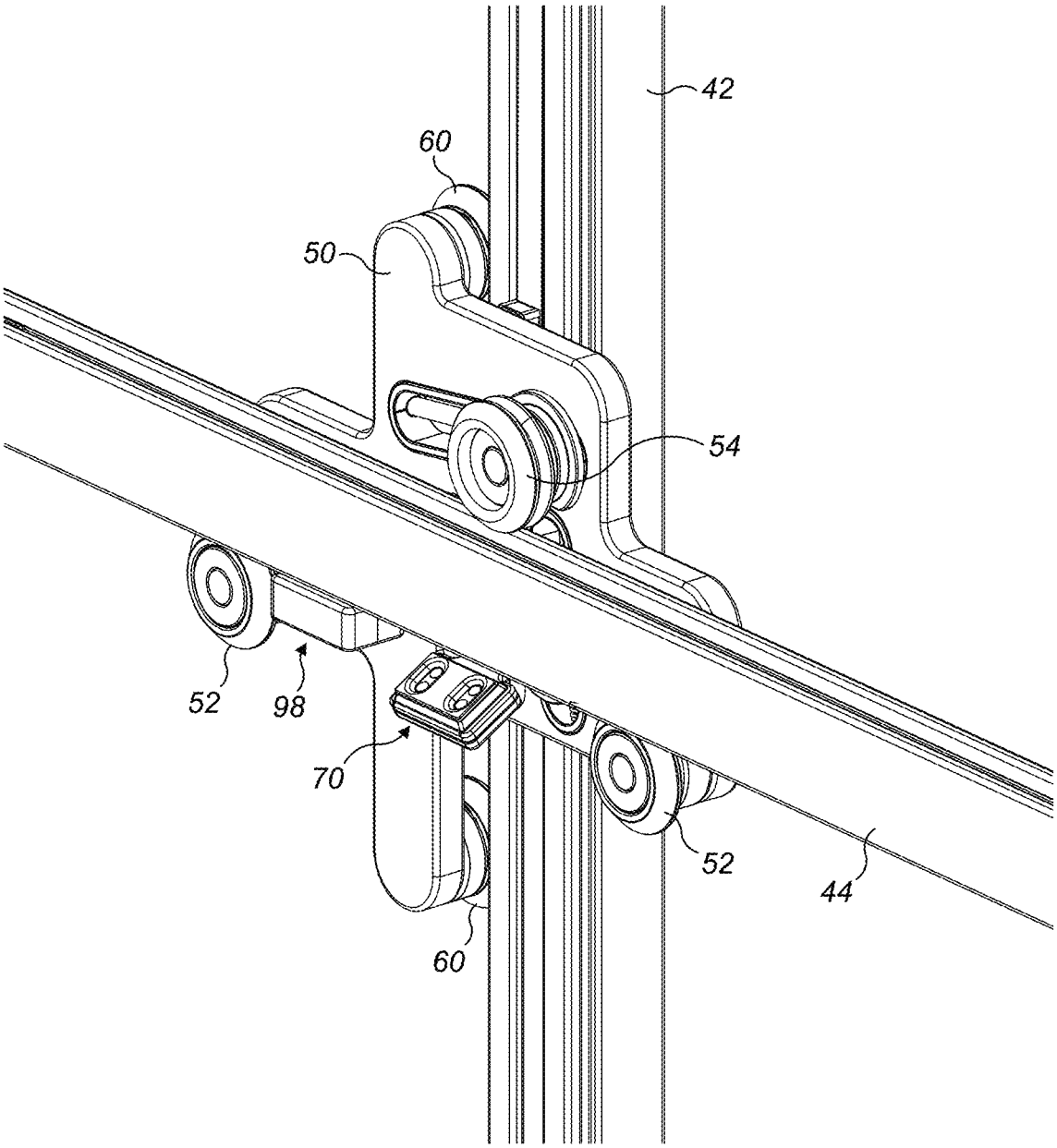
Figure 6A:
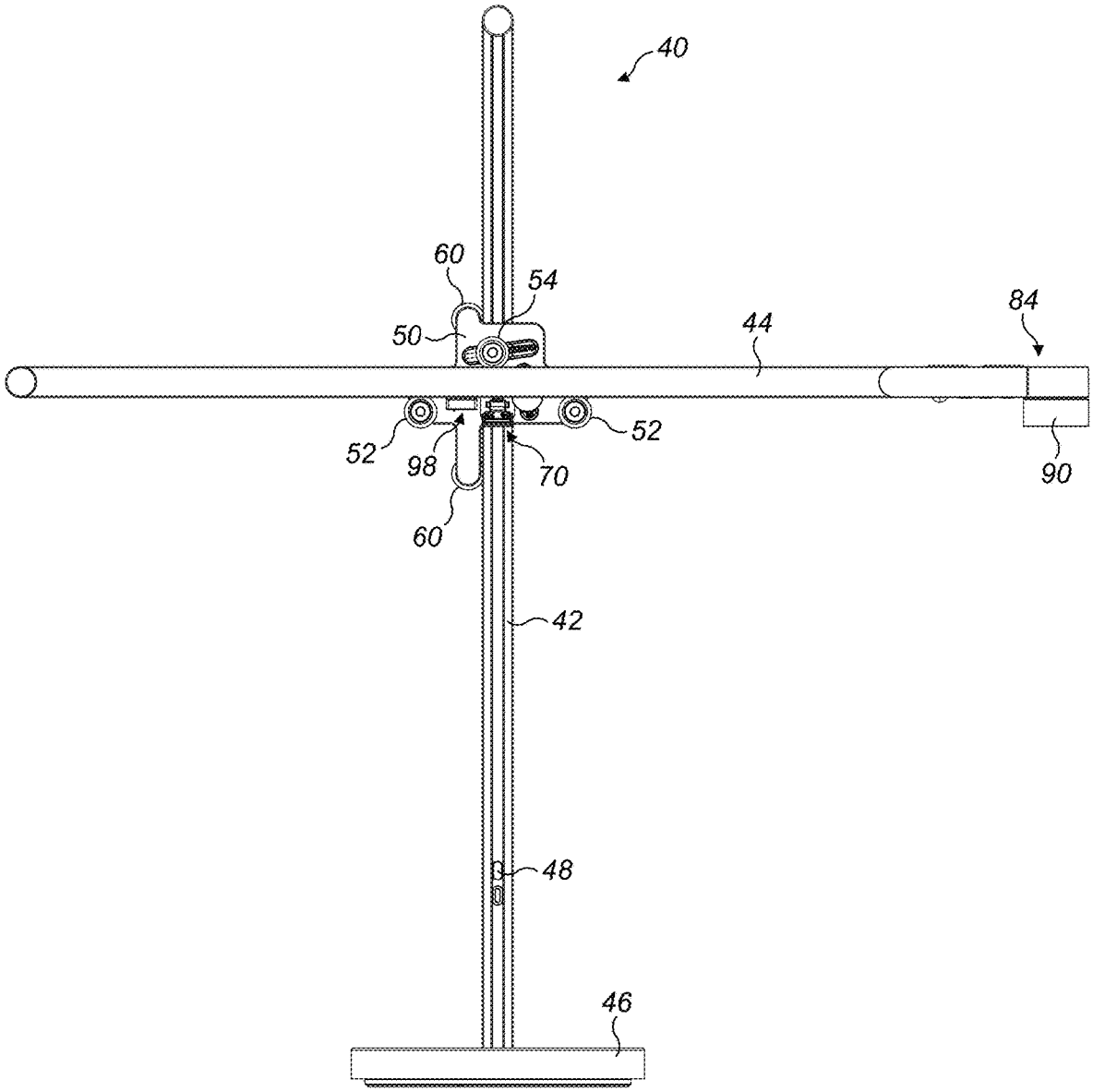
FIG. 6(*a*) is a front view of the lighting device as illustrated in FIG. 5(*a*) but with the upper guide in a deployed position, and FIG. 6(*b*) is perspective view of part of the lighting device as illustrated in FIG. 6(*a*)
Figure 6B:
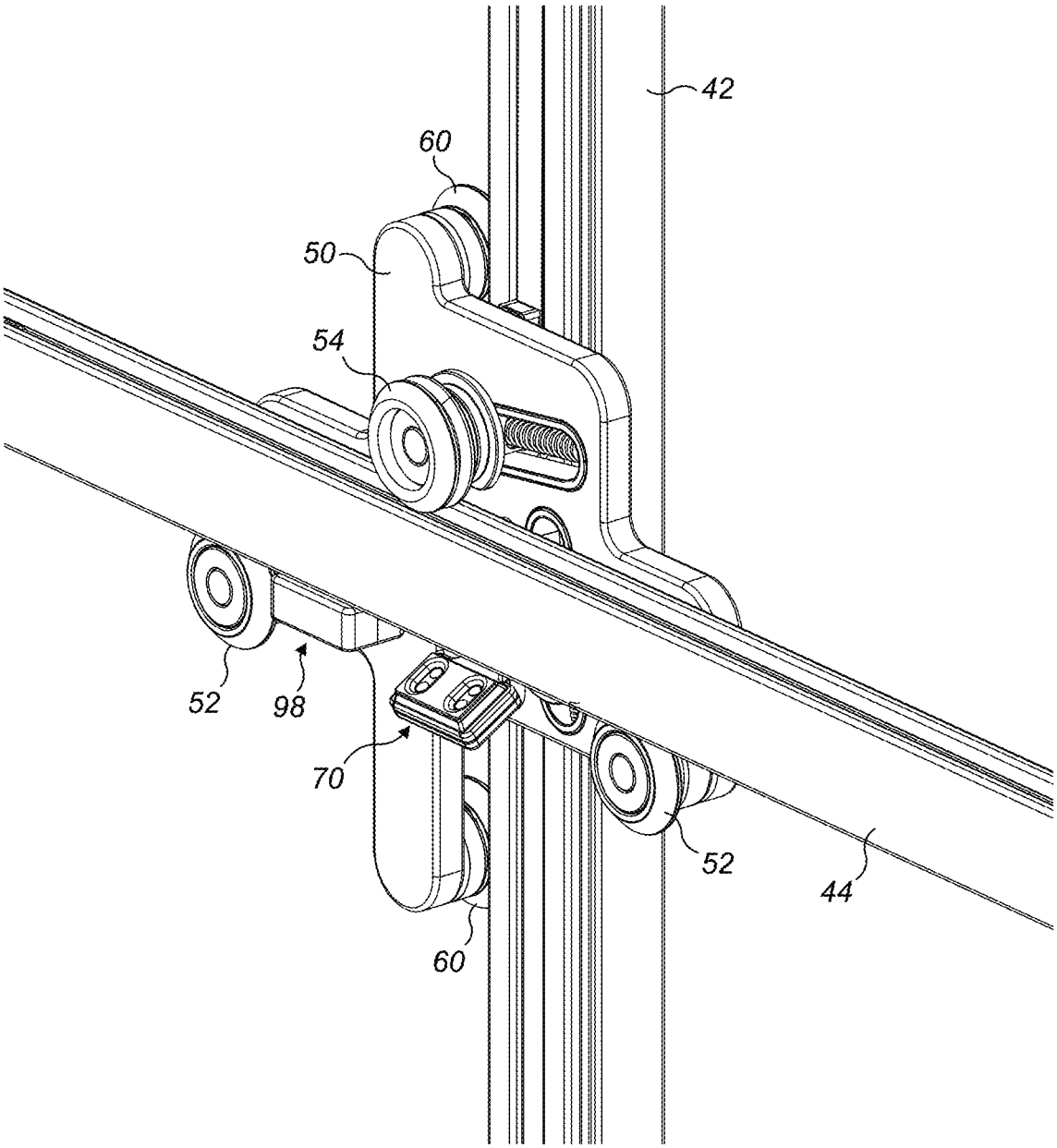

To connect the arm 44 to the support 42, the user first moves the upper guide 54 of the support plate 50 to its retracted position. Whilst maintaining the upper guide 54 in its retracted position, the user inserts the arm 44 between the lower guides 52 and the upper guide 54 so that the lower guides 52 enter the first channel 104 of the arm 44 and so that the second electrical connector 98 is positioned between the lower guides 52 and adjacent to the first electrical connector 70, as illustrated in FIGS. 5(*a*) and 5(*b*). In those figures, the arm 44 is illustrated in a first orientation, in which the light source 84 is located to a right hand side of the first connector 70. The user then releases the upper guide 54, which moves automatically to its deployed position, as illustrated in FIGS. 6(*a*) and 6(*b*), under the biasing force of the spring 56. As the upper guide 54 moves to its deployed position, the upper guide 54 enters the second channel 96 of the arm 44, which results in the arm 44 being held between the first set of guides.

Figure 7A:
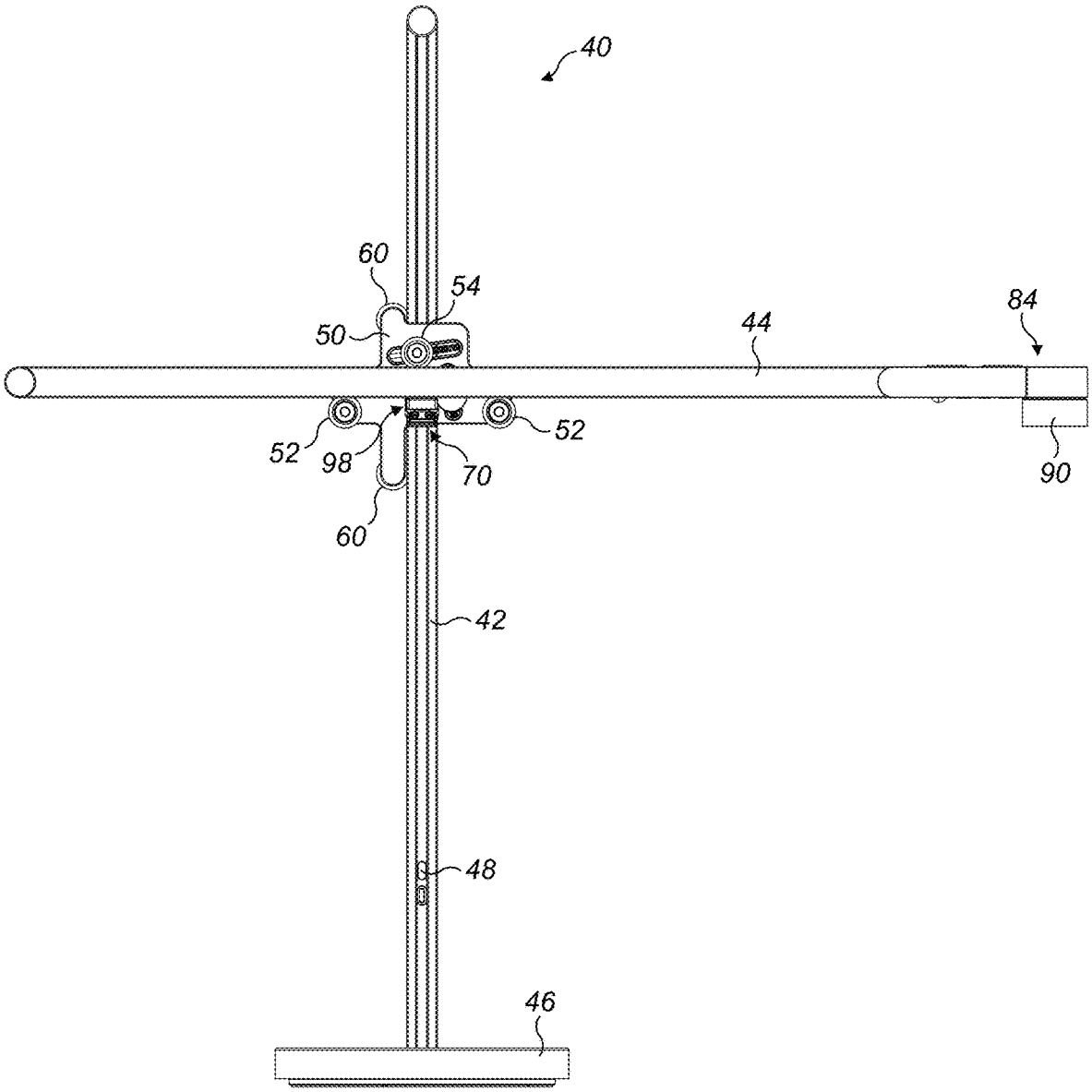
FIG. 7(*a*) is a front view of the lighting device as illustrated in FIG. 6(*a*) but with the arm moved horizontally relative to the support to align a second electrical connector of the arm with the first electrical connector, and FIG. 7(*b*) is a perspective view of part of the lighting device as illustrated in FIG. 7(*a*)
Figure 7B:
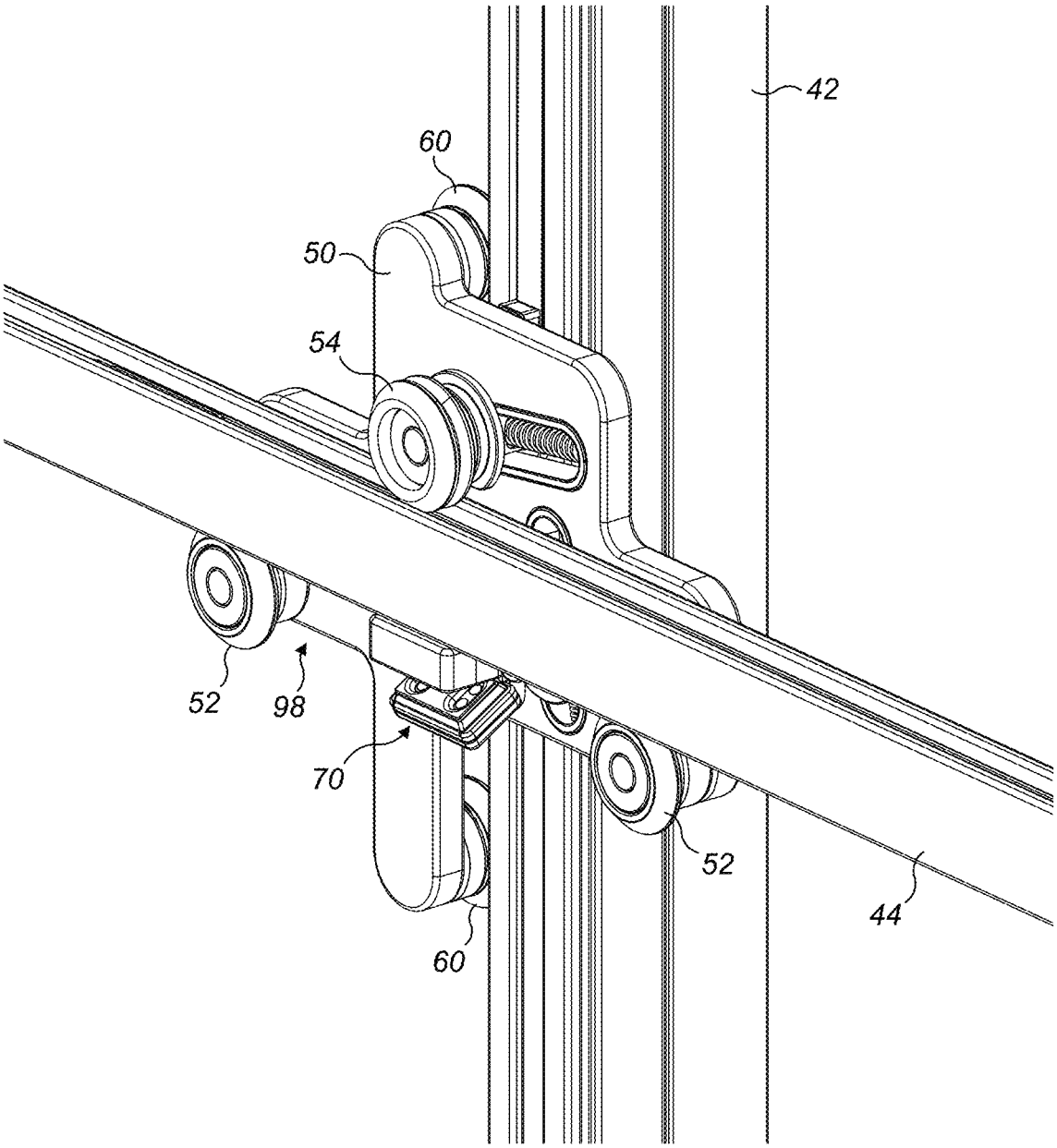

To form the electrical connection between the electrical connectors 70, 98, the user slides the arm 44 horizontally (to the right as illustrated in FIGS. 6(*a*) and 6(*b*)). The second electrical connector 98 moves with the arm 44 so as to become positioned immediately above the first electrical connector 70, as illustrated in FIGS. 7(*a*) and 7(*b*). As the electrical connectors 70, 98 become physically aligned, that is, with the second magnet 108 located immediately above the first magnet 80, the magnetic force of attraction between the magnets 80, 108 urges the ledge 78 to move from its lowered position to its raised position, as illustrated in FIGS. 8(*a*) to 9(*c*). The movement of the ledge 78 to its raised position, which is preferably a horizontal position, causes an electrical connection to be established through direct contact between a first pair of contacts 74 of the first electrical connector 70 and the pair of pins 102 of the second electrical connector 98, as illustrated in FIG. 9(*c*). The electrical connection thus established between the electrical connectors 70, 98 enables the user to switch on the light source 84 using the switch 48.

Figure 10A:
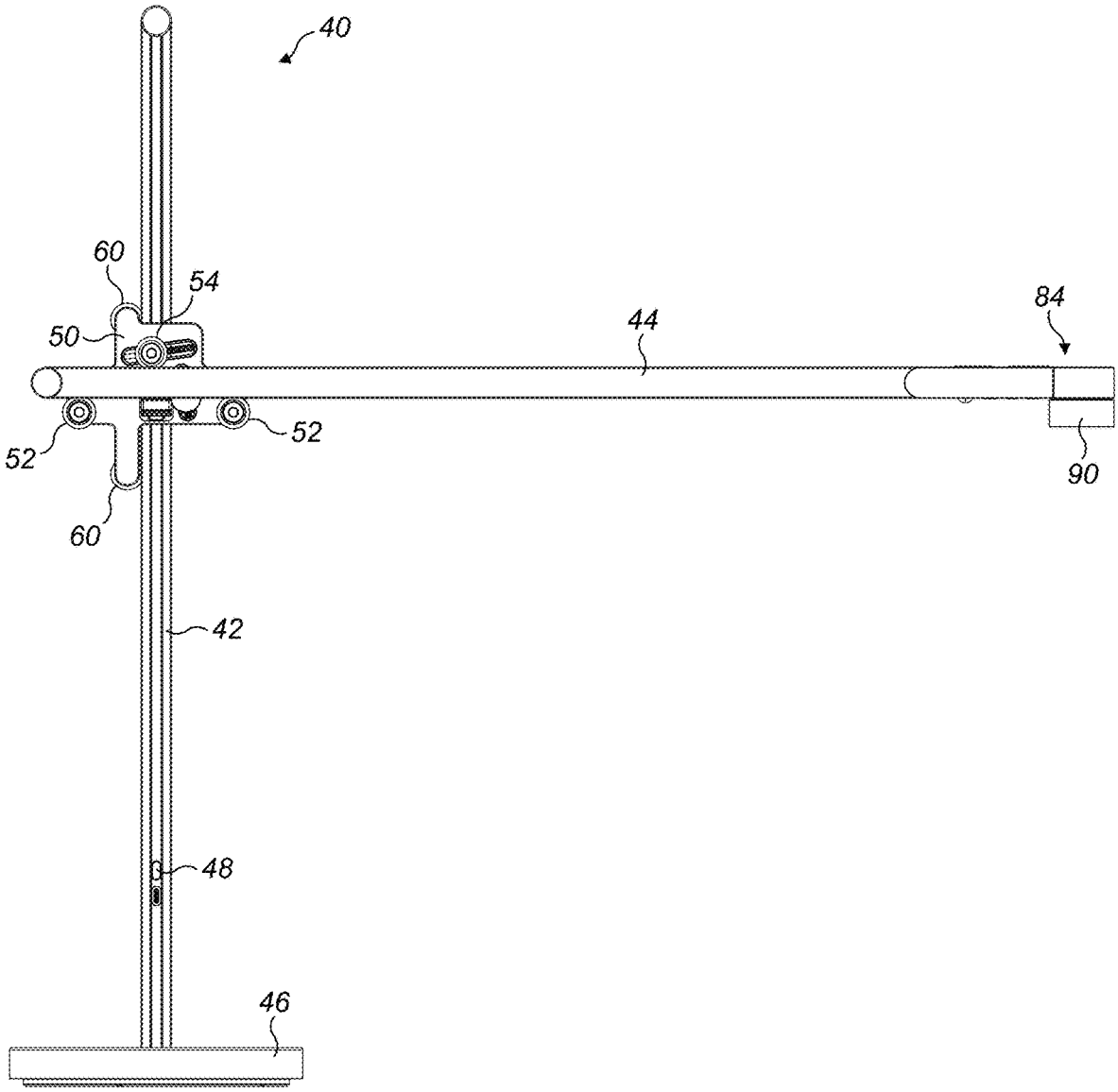
FIG. 10(*a*) is a front view of the lighting device as illustrated in FIG. 8(*a*) following a first lengthwise movement of the arm relative to the support, and FIG. 10(*b*) is a perspective view of the lighting device as illustrated in FIG. 10(*a*)
Figure 10B:
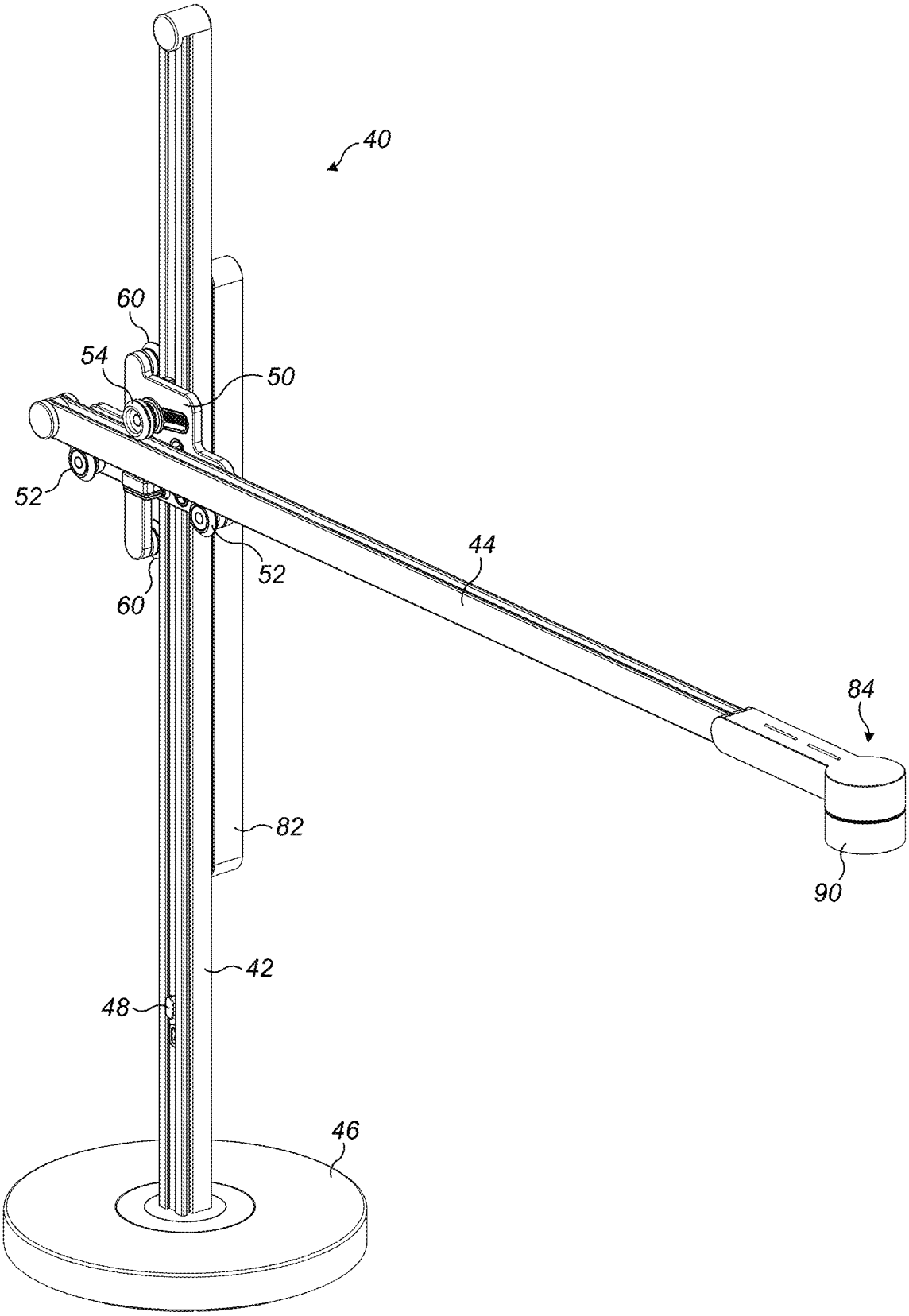
Figure 11A:
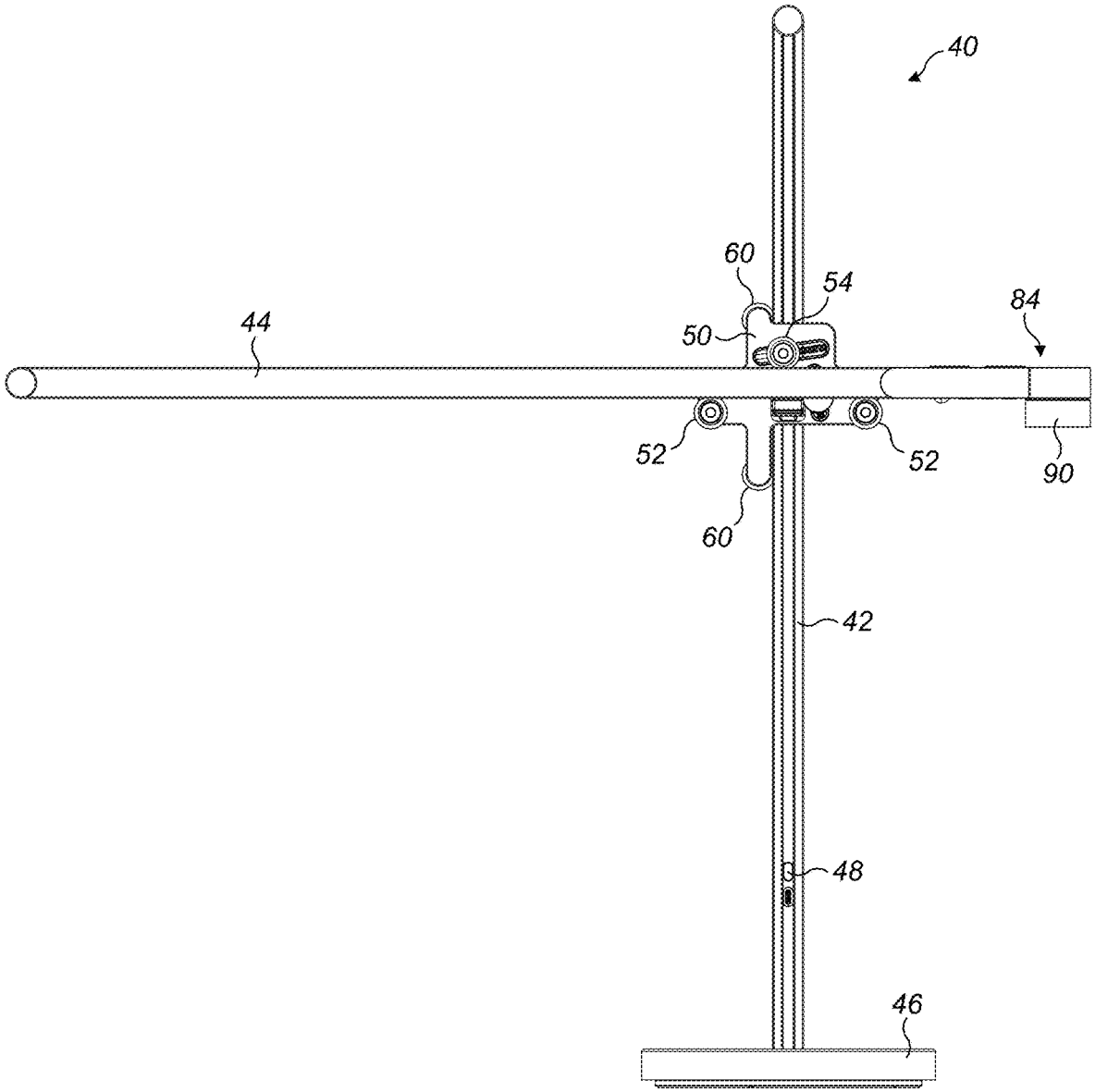
FIG. 11(*a*) is a front view of the lighting device as illustrated in FIG. 8(*a*) following a second lengthwise movement of the arm relative to the support, and FIG. 11(*b*) is a perspective view of the lighting device as illustrated in FIG. 11(*a*)
Figure 11B:
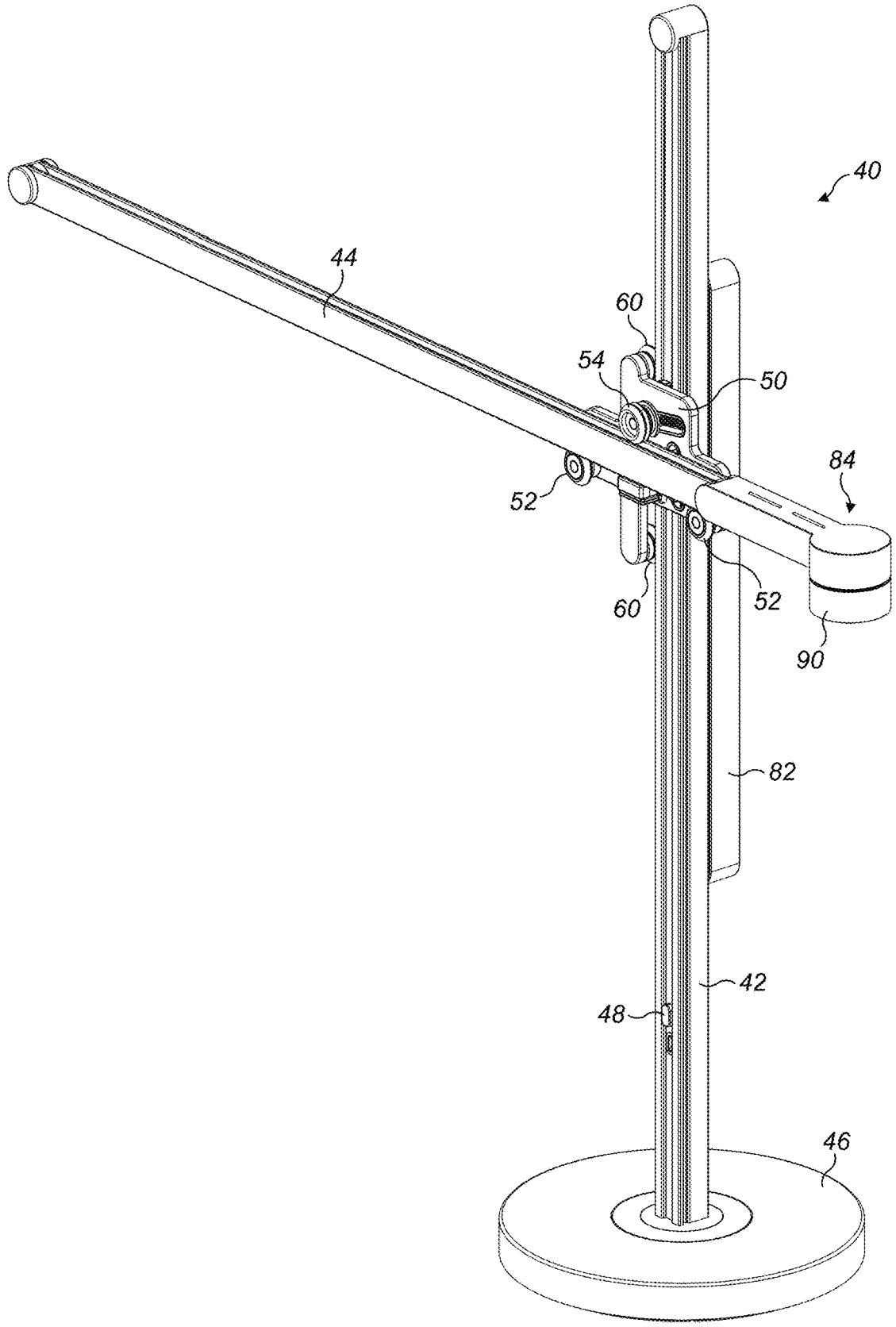

The arm 44 is moveable relative to the support between a first horizontal position, as illustrated in FIGS. 10(*a*) and 10(*b*), and a second horizontal position, as illustrated in FIGS. 11(*a*) and 11(*b*). The magnetic force of attraction between the magnets 80, 108 is selected such that the electrical connection between the electrical connectors 70, 98 is retained as the user slides the arm 44 between these two horizontal positions. As a result, the carriage 106 moves along the first channel 94 as the horizontal position of the light source 84 relative to the support 42 is adjusted by the user.

Figure 12:
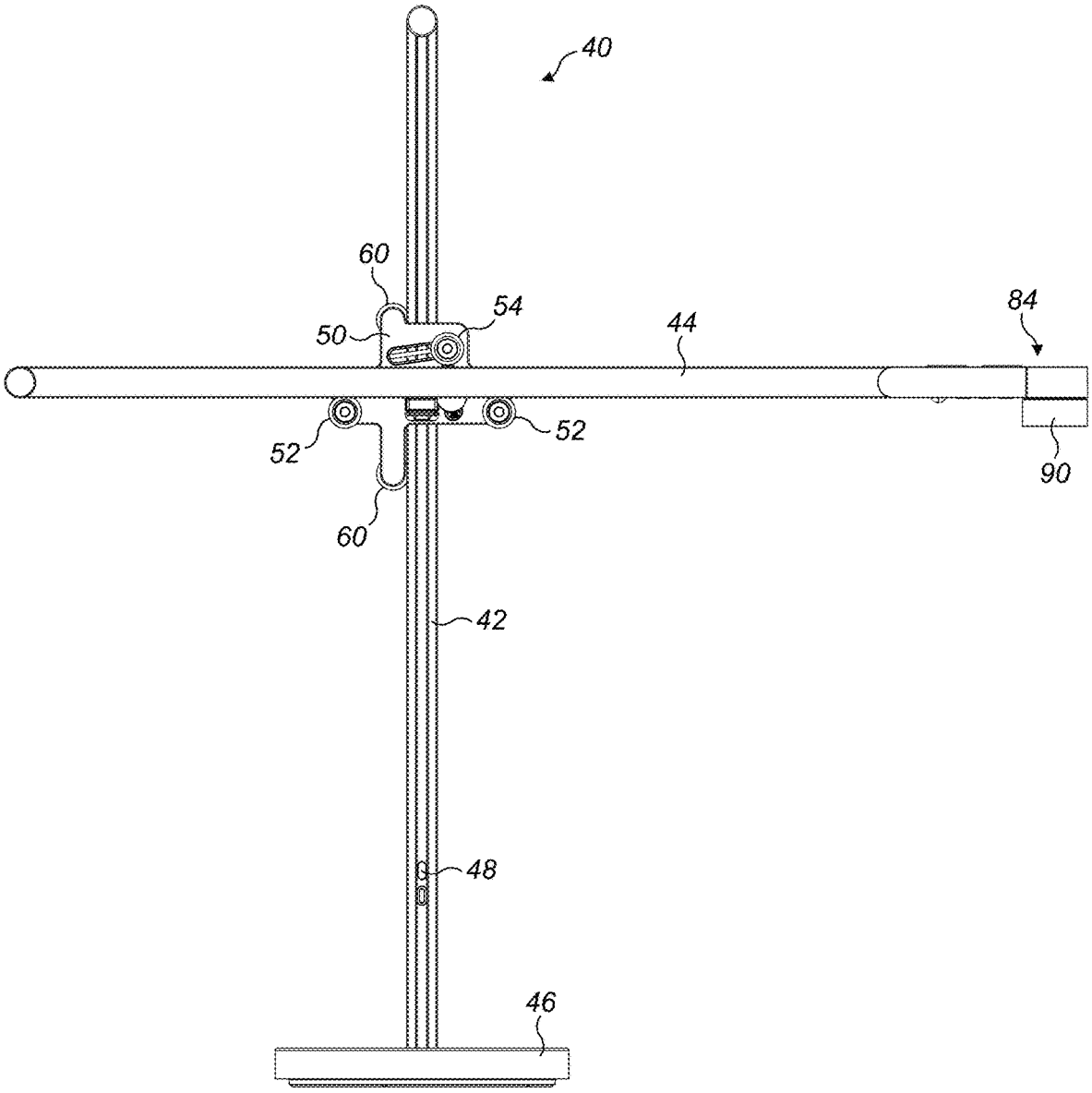
FIG. 12 is a front view of the lighting device as illustrated in FIG. 8(*a*) but with the upper guide in a retracted position.
Figure 13A:
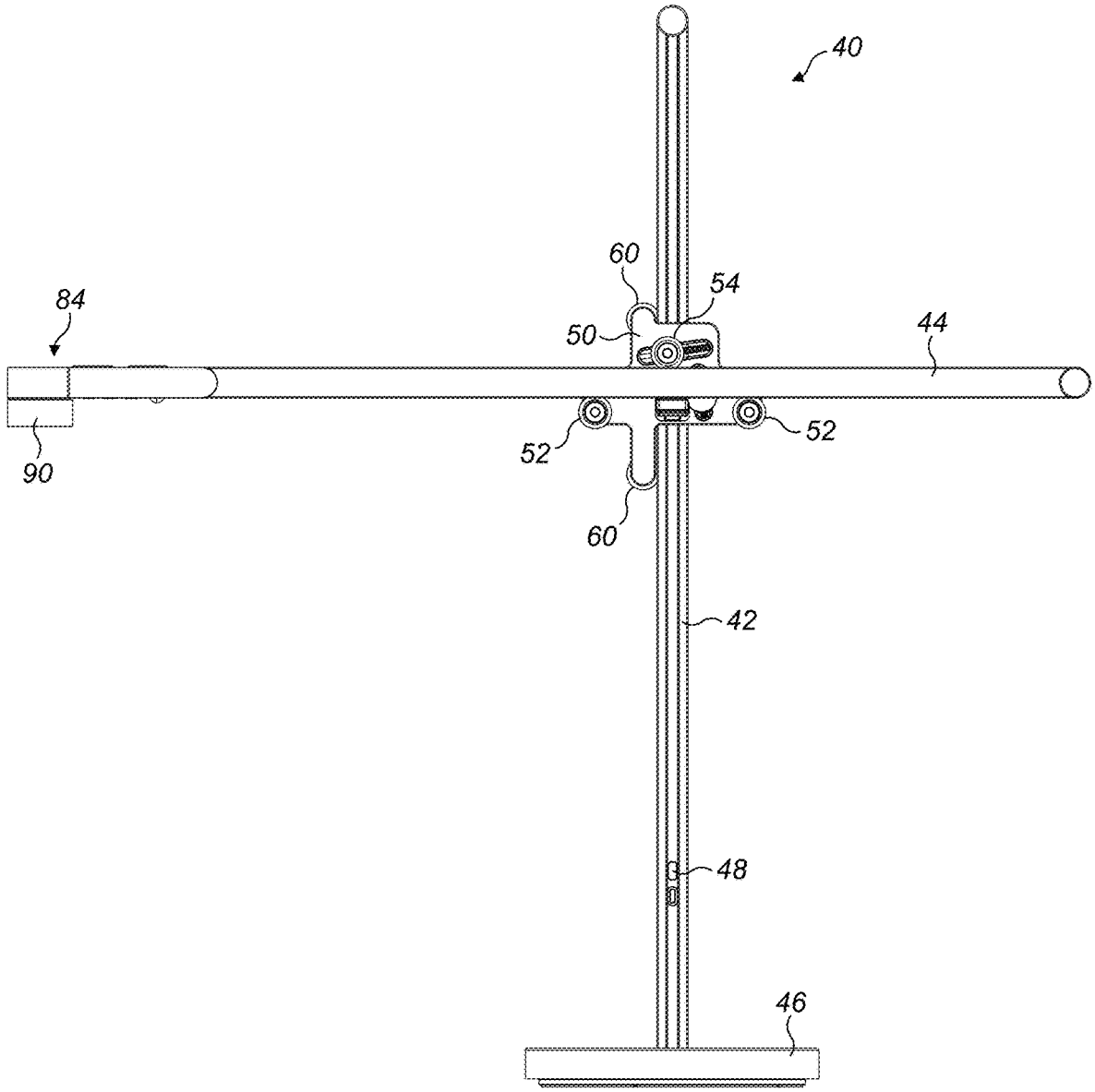
FIG. 13(*a*) is a front view of the lighting device as illustrated in FIG. 8(*a*) but with the arm in a reversed, second orientation, and FIG. 13(*b*) is a perspective view of the lighting device as illustrated in FIG. 13(*a*).
Figure 13B:
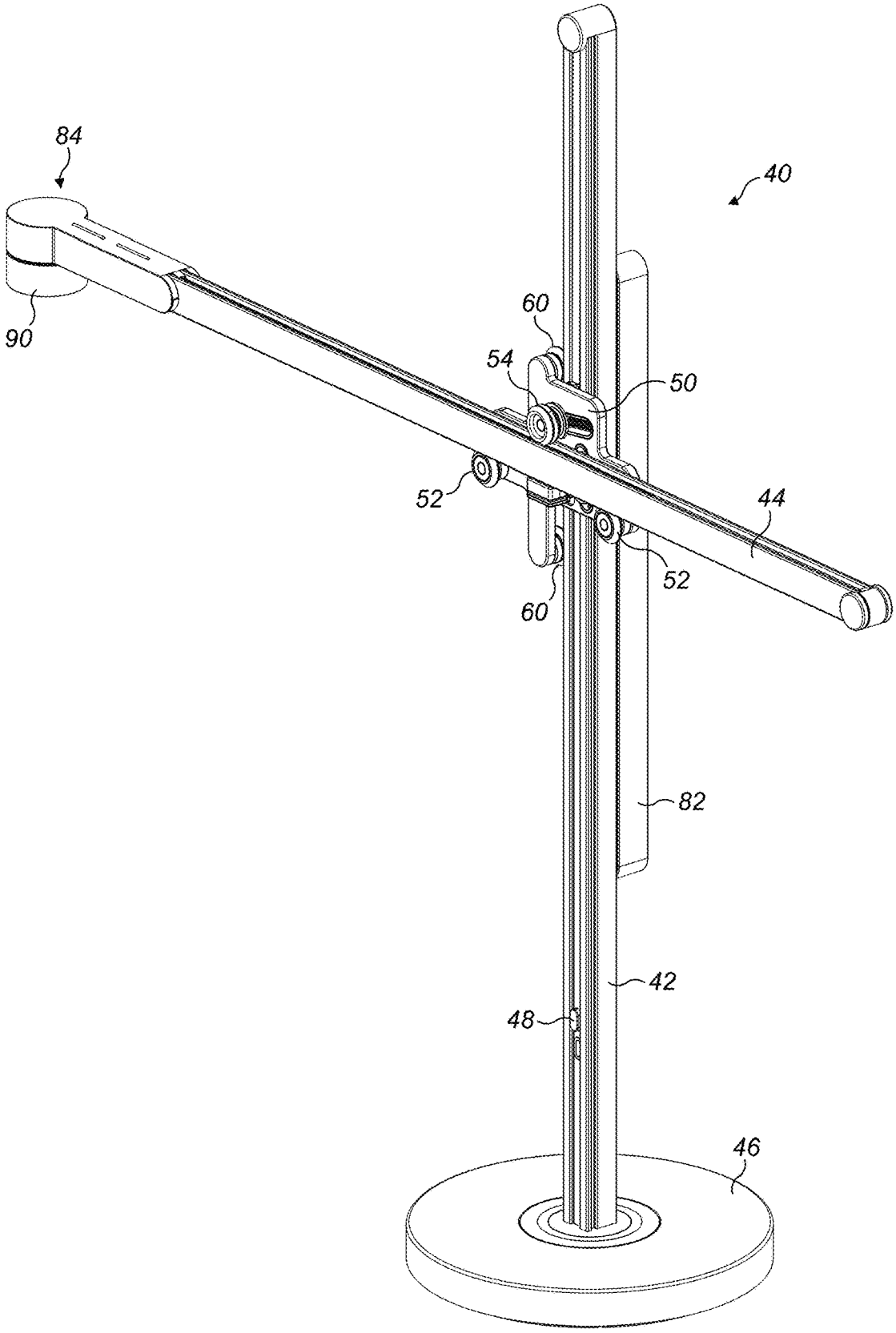

FIGS. 13(*a*) and 13(*b*) illustrate the lighting device 40 with the arm 44 mounted on the support 42 in the second orientation, in which the light source 84 is located to the left hand side of the first connector 70. This allows the user to illuminate a different portion of a desk or other work surface without exposing the rear surfaces of the support 42 and support plate 50 to a person located in front of the lighting device, and allows the switch 48 to continue to be readily accessible from in front of the lighting device 40. To change the orientation of the arm 44 relative to the support 42, the user first moves the upper guide 54 from its deployed position to its retracted position, as illustrated in FIG. 12. The user then lifts the arm 44 away from the lower guides 52. As the arm 44 moves away from the lower guides 52, the electrical connection between the electrical connectors 70, 98 becomes broken and the ledge 78 moves, under gravity, to its lowered position. The user then changes the orientation of the arm 44, through a 180° rotation about a vertical axis, and re-assembles the lighting device 40 as described above but with the arm 44 in its second orientation. Due to the reversal of the orientation of the arm 44, as the electrical connection is established between the electrical connectors 70, 98 the pins 102 of the second electrical connector 98 engage a second one of the pairs of contacts 74 of the first electrical connector 70.

In summary, a lighting device includes a support and an arm which is mountable on the support in a selected orientation for movement relative thereto. The arm has a channel extending at least partially along the length of the arm. A light source is mounted on the arm. A first electrical connector is mounted on the support, and a second electrical connector is mounted on the arm. The second electrical connector is detachably electrically connected to the first electrical connector, and is moveable along the channel with lengthwise movement of the arm relative to the support.

The invention claimed is:

1. A lighting device comprising:

a support;

a first electrical connector mounted on the support;

an arm comprising a first end, a second end spaced from the first end along the length of the arm, and a channel extending at least partially along the length of the arm;

a light source mounted on the arm, the arm being removably mountable on the support in a first orientation, in which the light source is located to one side of the first electrical connector, and a second orientation in which the light source is located to the other side of the first electrical connector, wherein the arm is removable from the support for switching between the first and second orientations; and a second electrical connector which is mounted to the arm and connected to the light source and detachably electrically connected to the first electrical connector, the second electrical connector being moveable along the channel with lengthwise movement of the arm relative to the support, wherein the second electrical connector is detachable from the first electrical connector to enable the arm to be removed from the support for switching between the first and second orientations.

2. The lighting device of claim 1, wherein the channel is located on one of an upper surface and a lower surface of the arm.

3. The lighting device of claim 1, wherein the first electrical connector is moveable relative to the support to connect the second electrical connector to the first electrical connector.

4. The lighting device of claim 3, wherein the first electrical connector is pivotable relative to the support to connect the second electrical connector to the first electrical connector.

5. The lighting device of claim 3, wherein the first electrical connector is moveable relative to the support between a raised position and a lowered position.

6. The lighting device of claim 1, wherein the first electrical connector is magnetically attracted towards the second electrical connector.

7. The lighting device of claim 1, wherein the support comprises a plurality of guides for releasably retaining the arm and for guiding movement of the arm relative to the support.

8. The lighting device of claim 7, wherein the plurality of guides comprises a set of guides between which the arm is insertable.

9. The lighting device of claim 8, wherein at least one of the set of guides is arranged to be at least partially received within said channel.

10. The lighting device of claim 8, wherein one of the set of guides is moveable relative to the arm between a deployed position for engaging the arm and a retracted position for allowing the arm to be detached from the support.

11. The lighting device of claim 10, wherein the moveable guide is biased towards its deployed position.

12. The lighting device of claim 10, wherein the moveable guide is at least partially located in a second channel of the arm when in its deployed position.

13. The lighting device of claim 12, wherein the second channel is located on an opposite side of the arm to said channel.

14. The lighting device of claim 7, wherein each of the guides comprises a roller which is rotatably mounted on a support plate.

* * * * *